United States Patent [19]

Pate et al.

[11] Patent Number: 4,589,398

[45] Date of Patent: May 20, 1986

[54] COMBUSTION INITIATION SYSTEM EMPLOYING HARD DISCHARGE IGNITION

[76] Inventors: Ronald C. Pate, 10263 Rempas Dr., NW., Albuquerque, N. Mex. 87114; Raymond E. Hensley, 3805 Garcia Northeast, Albuquerque, N. Mex. 87111

[21] Appl. No.: 583,694

[22] Filed: Feb. 27, 1984

[51] Int. Cl.[4] ..... F02P 1/00; F23Q 3/00

[52] U.S. Cl. ..... 123/596; 123/598; 123/594; 313/138

[58] Field of Search ..... 123/594, 596, 598, 605, 123/620, 143 B; 361/257; 313/138, 141, 143

[56] References Cited

U.S. PATENT DOCUMENTS 4,333,125 6/1982 Hensley et al. ..... 361/257
4,333,126 6/1982 Hensley et al. .
4,402,036 8/1983 Hensley et al. .

FOREIGN PATENT DOCUMENTS

3024667A1 of 0000 Fed. Rep. of Germany ..... 361/257

OTHER PUBLICATIONS

"On the Effective Energy for Direct Initiation of Gaseous Detonations", Knystautas et al, American Elsevier Publishing Co., 1976.

"Influence of Ignition on Inflammation and Flame Propagation", Ziegler et al, First Specialists Conference, 1981.

Martin, J. C., "Duration of the Resistive Phase and Inductance of Spark Channels", Air Force Weapons Lab (AFWL) Switching Notes, Note 9, 1965.

Sorensen, T. P. and Ristic, V. M., "Rise Time and Time-Dependent Spark-Gap Resistence in Nitrogen and Helium", J. Appl. Phys., V. 48, No. 1, pp. 114–117, 1977.

Albrecht, N., Bloss, W. H., Herden, W., Maly, R., Saggau, B., and Wagner, E., "New Aspects on Spark Ignition", SAE paper 770853, 1977.

Maly, R. and Vogel, M., "Initiation and Propagation of Flame Fronts in Lean $CH_4$-Air Mixtures by the Three Modes of the Ignition Spark", Seventeenth Symposium (International) on Combustion, pp. 821–831, 1979.

Ziegler, G. and Maly, R., "Influence of Ignition on Inflammation and Flame a Propagation", First Specialists Conference (International) of the Combustion Institute, pp. 89–94, 1981.

Knystautas, R. and Lee, J. H., "On the Effective Energy for Direct Initiation of Gaseous Detonations", *Comb. and Flame,* V. 27, pp. 221–228, 1976.

Wadsworth, Jr., "Use of Flash Photolysis to Initiate Detonation in Gaseous Mixtures", Nature, V. 190, pp. 623–624, 1961.

Lee, J. H., Khystautas, R., and Yoshikawa, N., "Photochemical Initiation of Gaseous Detonations", *ACTA Astron,* V. 5, pp. 971–982, 1978.

Andreev, S. I. and Vanyukov, M. P., "Application of a Spark Discharge to Obtain Intense Light Flashes of Length 10-7-10-8 Second: I. Investigation of Electrical Processes in a Spark Discharge of Nanosecond Duration", *Sov. Phys. Tech. Phys.,* V. 6, No. 8, pp. 700–708, 1962.

(List continued on next page.)

*Primary Examiner*—Ronald B. Cox
*Attorney, Agent, or Firm*—Cullen, Sloman, Cantor, Grauer, Scott & Rutherford

[57] ABSTRACT

A system for initiating combustion of fuel, especially for internal combustion engines, employs a very rapid, intense high power electrical breakdown arc to increase the rate of combustion and thereby reduce the need for advanced engine timing. The use of a distribution circuit which has exceptionally low inductance and resistance results in the rapid electrical breakdown and coupling of at least 80% of stored pulse energy to the breakdown arc channel within the first half period of the discharge current cycle. The resulting arc discharge effects detonation of the fuel mixture through the cooperative effects of photolysis, supersonic hydrodynamic shockwave and high temperature thermal plasma. High voltage pulse generation distribution and switching circuits are provided. Several discharge electrode geometries and closely coupled pulse forming networks for the discharge device are disclosed.

14 Claims, 59 Drawing Figures

OTHER PUBLICATIONS

Andreev, S. I. and Vanyukov, M. P., "The Use of Spark Discharge for Obtaining Intense Light Flashes of 10--7-10-8 Second Duration: II. Investigation of Optimum Relationship Between Energy of Spark Discharge in Air and Duration of Light Flash", *Sov. Phys. Tech. Phys.*, V. 7, No. 6, pp. 538-543, 1962.

Andreev, S. I., Vanyukov, M. P., and Kotolov, A. B., "Growth of the Spark Discharge Canal for a Discharge Circuit with a Rapidly Increasing Current", *Sov. Phys. Tech. Phys.*, V. 7, No. 1, pp. 37-40, 1962.

Ziegler, G. F. W., Maly, R. R., and Wagner, E. P., "Effect of Ignition System Design on Flammability Requirements on Ultra-Lead Turbulent Mixtures", *I. Mech. E.*, paper No. C47/83, 1983.

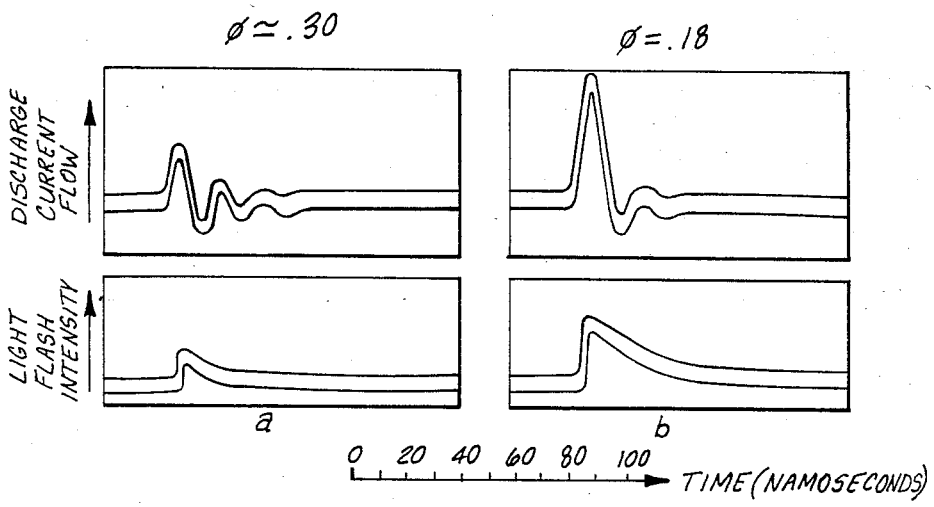
Fig-4
Fig-14G
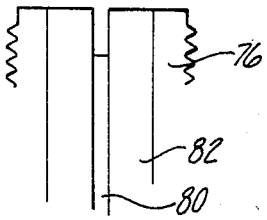
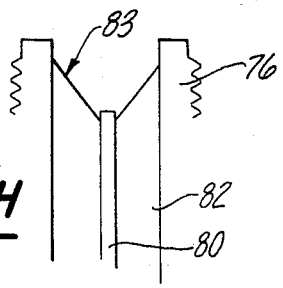
Fig-14H
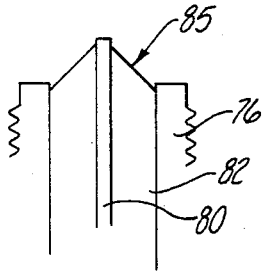
Fig-14I
Fig-14J
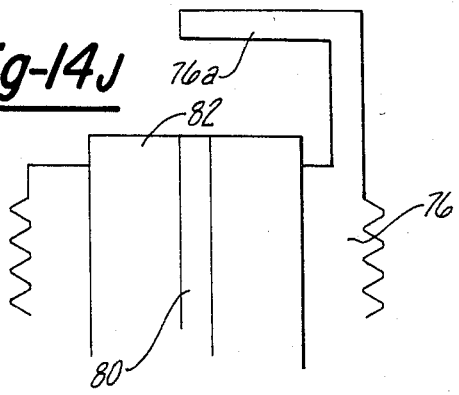

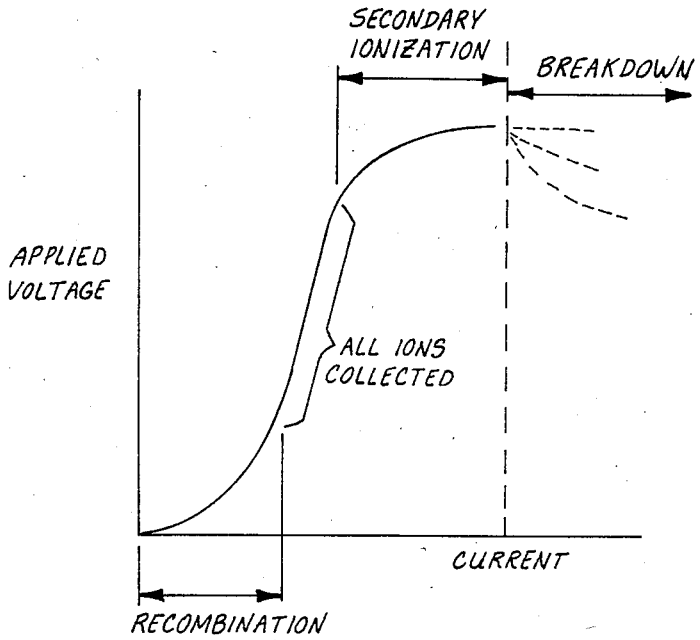
Fig-5
Fig-6
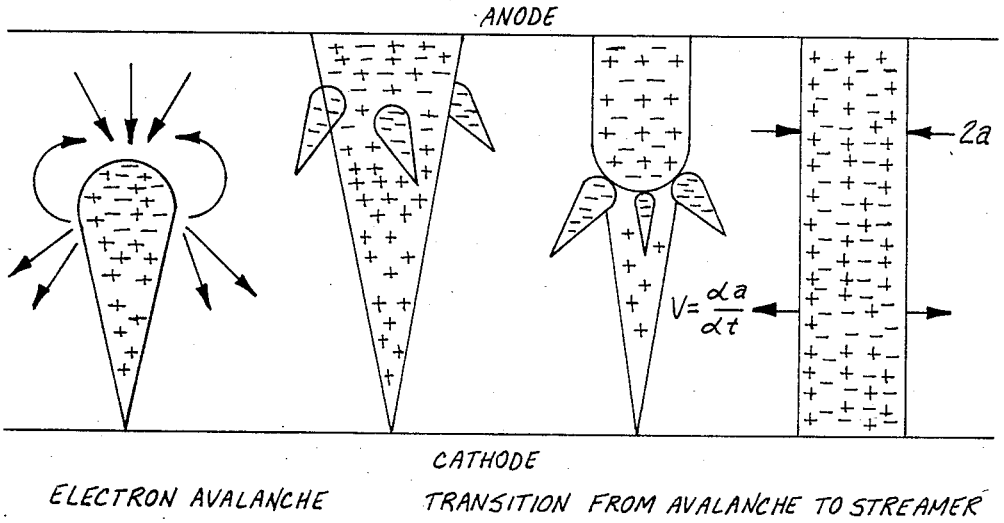

20
t=0
V
d
22

24

26
28

2a
V=da/dt 24
2a
EARLY FORMATIVE PHASE
LATER FORMATIVE PHASE CHANNEL EXPANSION

POSSIBLE STRIPLINE TERMINATION-CONNECTOR

PRIMARY VOLTAGE AND SECONDARY CURRENT VS. TIME
K = 0.600 : WP/WS = 1.000

SECONDARY VOLTAGE AND PRIMARY CURRENT VS. TIME
K = 0.600 : WP/WS = 1.000

Fig-27
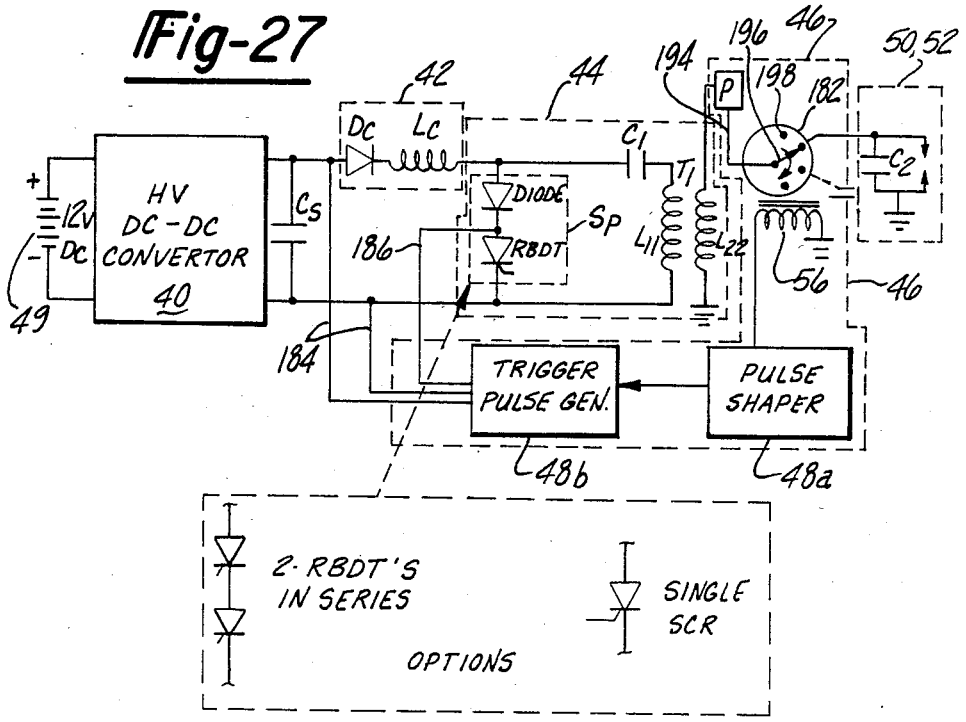
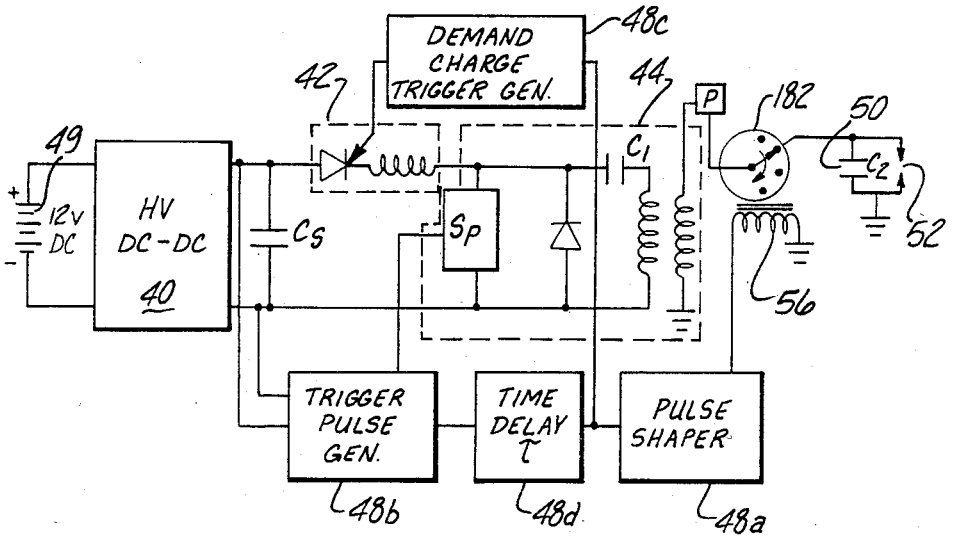
Fig-28

COMBUSTION INITIATION SYSTEM EMPLOYING HARD DISCHARGE IGNITION

TECHNICAL FIELD

The present invention broadly relates to systems for initiating and enhancing combustion of fuel and fuel-air mixtures and deals more particularly with a system for increasing the efficiency with which electrical discharge energy is coupled into the fuel by ignition and combustion enhancement devices, thereby initiating and promoting a more rapid combustion event, and also extending the lean operating limit of the fuel mixture.

BACKGROUND ART

Initiation of fuel combustion, particularly for compression-type internal combustion engines, is a well-developed art which has its origin in the Otto-cycle Spark Ignition (SI) engine that was developed in the late 1800's. During the past century, the internal combustion (IC) engine has undergone considerable improvement in its design and performance. Along with basic IC engine development have come considerable technological improvements in the associated ignition system.

The earliest ignition systems employed a high voltage magneto. The magneto was gradually replaced during the 1920's by a battery-based induction coil system which utilized mechanical breaker points as a current-interrupt switch. The coil ignition (CI), invented by Charles Kettering, became the standard for automotive applications and maintained that status for several decades with remarkably little change in design or operation.

The advent of reliable semiconductor switching devices, commencing approximately 30 years ago, introduced technology which led to the gradual elimination of performance limitations and maintenance problems associated with mechanical breaker points. Transistor-assisted-contact (TAC) systems were devised in which a transistor switch relieved the mechanical breaker points of the burden of carrying high current flow. More recently, mechanical breaker points have been entirely replaced by "breakerless" timing circuitry and ignition systems based exclusively on semiconductor switching technology. Recent efforts have also been made to eliminate the conventional mechanical rotor system for high voltage ignition pulse distribution.

The availability of fast switching power transistors and thyristor devices (e.g., silicon controlled rectifiers) has given rise during the last few decades to a variety of capacitor discharge ignition (CDI) systems. In contrast to the inherently slower (typically 60–200 microseconds rise time) longer lasting (typically 1–2 milliseconds) output pulses characteristic of induction coil systems, CDI systems provide faster rising pulses (1–50 microseconds) at the expense of shorter overall duration (5–500 microseconds). The faster rising pulses of CDI systems are less susceptible to misfire due to spark plug fouling.

Modern conventional coil and capacitor discharge systems usually deliver between 5 to 100 millijoules (mJ) of electrical energy per pulse at peak output voltages ranging from 20,000 to 30,000 volts. The more common systems operate in the energy range of 20 to 50 mJ per pulse.

Before discussing prior art systems in more detail, it is necessary to appreciate the physical phenomena by which thermal ignition occurs. Gaseous electrical discharge typically occurs in three common phases:

(1) a breakdown phase, usually less than a few tens of nanoseconds in duration, in which current flow increases rapidly as the voltage across the discharge gap falls, (2) a transition to arc discharge of relatively high internal energy content and current density, (3) possibly followed by transition to glow discharge characterized by somewhat lower internal energy and current density.

The overall duration of an ignition system discharge, and the relative fraction of total energy deposited during the breakdown, arc, and glow phases are primarily governed by the circuit parameters of the system. The discharge circuits of conventional systems typically have high inductance, low capacitance and relatively high resistance. These high impedance systems couple only a small fraction of the discharge energy into the fuel mixture during the brief breakdown phase. CDI systems generally deliver a current pulse consisting primarily of the arc phase. Transistor-coil-ignition (TCI) systems on the other hand, emphasize a relatively quick transition from breakdown to a long duration, low current glow discharge which is accomplished by gradually releasing the energy stored in the magnetic field of the coil through a high impedance discharge circuit.

Within the last several years, the establishment of strict exhaust emission standards and a demand for better fuel efficiency have placed additional constraints on engine operation. In response to these demands, recent trends in engine design and operation have been toward promoting a faster combustion process and extending stable operation to leaner fuel mixtures.

Operating with lean or EGR (exhaust gas recycle)-diluted mixtures can achieve significant reductions in exhaust emissions while increasing thermal combustion efficiency and reducing specific fuel consumption. Conversely, lean burn is characterized by more difficult ignition and slower laminar flame velocity, which, with increasing mixture dilution, eventually leads to cycle-by-cycle (CBC) variations, incomplete combustion, and a subsequent increase in unburned hydrocarbon emissions.

Promoting a faster combustion process, on the other hand, increases engine cycle efficiency (thereby lowering specific fuel consumption), permits operation with lower octane fuels or higher compression ratios, reduces CBC variations, and allows for stable engine operation with more dilute fuel mixtures.

It is known that higher combustion efficiencies can be achieved by increasing compression ratios; at a given compression ratio, highest operating efficiency occurs under conditions of constant-volume heat addition (i.e. very rapid combustion) which corresponds to a very rapid (ideally instantaneous) combustion process. Thus, fast-burn Otto-cycle engines are theoretically capable of achieving higher overall cycle efficiency than diesel engines at a given compression ratio. In practice, however, diesel engines are generally more efficient than relatively slow burning gasoline engines due to the ability of the diesel to work at higher compression ratios. However, with faster combustion rates, the Otto-cycle engine efficiency not only increases but also permits operation at higher compression ratios. This in turn leads to further increases in efficiency which can result in Otto-cycle engine performance which more closely approaches conventional diesel engines.

Turbulence is known to be a mechanism by which the effective rate of combustion can be increased. A primary approach toward faster, leaner burn operation has involved the development of engine designs which enhance turbulence and fluid mechanical effects in the mixture within the combustion chamber.

It has been experimentally established that minimum spark ignition energy requirements correspond to fuel mixtures which are at, or somewhat rich of, the stoichiometric* ratio. This mixture range corresponds to maximum laminar flame velocity and maximum engine power output, and is the point where engines traditionally operated prior to 1970. However, as the fuel mixture becomes leaner, the minimum energy required for ignition increases dramatically. Furthermore, ignition of flowing mixtures can be more difficult than ignition of the same mixture under quiescent conditions. Consequently, the increased bulk fluid motion and turbulence which is often introduced into the fuel mixture to promote more rapid combustion adds to the demands of an ignition system which is already burdened by the difficulties of igniting a leaner mixture. In the past, it has not been possible to enhance ignition performance to satisfactorily overcome these problems. Moreover, successful engine operation with very lean mixtures** can ultimately only be achieved by the combined application of ignition enhancement measures and combustion rate increase mechanisms which offset the general slowdown in combustion kinetics that accompany mixture dilution.

*A stoichiometric air-to-fuel mixture contains the exact amount of air necessary to completely burn the fuel. The air-to-fuel mass ratio for octane is about 15:1.

**Air to fuel ratios greater (leaner) than about 20:1

As used herein, factors which promote more rapid overall combustion are termed "combustion enhancement" mechanisms while factors that promote a quicker, more probable initiation of combustion are termed "ignition enhancement" mechanisms. Ideally, it would be desirable for an ignition system to provide enhancement factors that surpass the early ignition stage and influence the entire combustion process.

Considerable controversy has existed in the past as to how ignition enhancement can best be achieved. This has been due in part to the lack of adequate theory to satisfactorily model the broad scope of complex physical and chemical processes which take place during spark discharge ignition. It has been generally accepted that the main spark ignition mechanism involves the creation of a volume of hot ionized gas (plasma ignition kernel) which envelopes a sufficient quantity of fuel mixture for a sufficient length of time to thermally initiate the exothermic combustion reactions that are then capable of establishing a self-sustaining, propagating reaction zone, sometimes referred to in the art as a "flame front". The remaining fuel mixture in the combustion chamber is ignited by the advancing flame front which moves radially outward at subsonic speed from the initiation region at the surface of the ignition kernel. Depending upon the turbulence condition within the combustion chamber and the laminar burn velocity of the mixture, the average effective flame front speed will usually be within the range of 15 to 30 meters per second.

The thermal criteria for plasma ignition kernel size, duration, and rate of expansion are generally based on the establishment of a temperature gradient, having, as a minimum, the same magnitude and spatial proportions as would exist in a self-sustaining reaction zone in the same mixture. This minimum temperature profile must then be maintained for the duration of the effective induction time of the combustion reaction sequence. The effective induction time decreases as the temperature gradient at the ignition kernel boundary increases beyond the minimum flame front requirements, thereby speeding up the ignition process.

On the other hand, the higher temperature gradients that accompany an over-driven kernel promote more rapid heat losses that, unless offset by ignition system energy delivery, lead to faster cooling of the plasma volume. This can result in a slowing down or termination (quenching) of the thermally driven ignition process. Simplified quantitative treatments of this process have generally been based on the balance between ignition system energy input in the form of plasma heating, and energy output in the form of thermal losses to the spark gap electrodes and the cooler surrounding gas mixture. Such thermal ignition models often view the plasma kernel as quasi-static, usually assume thermodynamic equilibrium, and neglect the rapid, dynamic breakdown processes that initially create and expand the discharge channel. Ignition models also usually neglect the detailed complexities of chemical combustion kinetics. Thermal models apply reasonably well to relatively long duration arc and glow discharge operation which is characteristic of conventional ignition systems.

Because of ignition delay associated with chemical reaction induction time, and due to the relatively slow propagation velocity of the combustion flame front, it is normally necessary to initiate the ignition spark in an IC engine well before the piston reaches top dead center (TDC) at the end of the compression stroke. This advance in ignition timing causes a portion of the fuel to be burned before the piston reaches TDC, thus resulting in negative work and loss of torque; this problem is exacerbated with slower burning, harder to ignite (longer induction time), leaner mixtures which demand greater timing advance.

With the foregoing basic principles of thermal ignition as background, recent approaches toward ignition enhancement have been directed at empirically optimizing spark ignition electrode geometry, orientation, and placement within the combustion chamber, as well as extending the duration and/or spatial distribution of the plasma kernel. Known ignition enhancement systems usually operate at higher energy levels, ranging from about 60 mJ to several joules per pulse. These systems may provide a single, long lasting glow or low current arc discharge, or a sequence of several shorter discharges which yield effective ignition kernel durations from 2 to 10 milliseconds. Greater spatial distribution of the kernel is most often achieved by using a wider discharge gap. This requires an ignition system capable of consistently delivering the higher voltage necessary to ensure gap breakdown.

Another approach to kernel distribution is the use of multiple ignitors at different locations in the cylinder head. Still other techniques have involved inducing plasma kernel motion through the application of electromagnetic body forces and thermal pressure, thereby propelling the kernel well into the fuel mixture and away from quenching surfaces. More particularly, the plasma jet ignition (PJI) has undergone considerable investigation during the last decade and has been shown to be very effective in promoting faster, leaner engine combustion. The PJI possesses excellent ignition probability characteristics even with ultra-lean fuel mixtures and is not prone to classical misfire. Furthermore, it has been shown to exert influence beyond the early ignition phase and to enhance later combustion by introducing turbulence effects and by distributing combustion promoting ionic species. Unfortunately, the plasma jet is undesirable from the standpoint of electrode erosion which renders it impractical for commercial use in engines.

Various other known experimental systems utilize laser, photochemical, and microwave techniques. However, none of these techniques have proven practical for commercial use.

The more practical engine enhancement systems of which we are aware have, with varying success, extended engine operation to leaner mixtures at the usual expense of highly advanced timing that is characteristic of slow, lower performance combustion. Better results are generally achieved in engines with fast burn chamber design, but stable, practical operation has rarely been extended to air-fuel mixture ratios significantly leaner than about 20:1 without suffering significant loss of engine performance, increased specific fuel consumption, and increased unburned hydrocarbon emissions.

Continued improvements in ignition enhancement systems have been limited by the traditional emphasis on establishing a thermally initiated burn kernel from an arc or glow discharge. These two relatively quasi-static modes of discharge operation are basically limited to low-power dissipation joule heating as the means of converting electrical energy into kinetic activation energy in the plasma ignition kernel. The resulting thermal kernel is mainly limited to the mechanism of gradient-driven heat flow as the means of transferring kinetic energy to, and inducing combustion in, the reactive mixture. This is augmented by the presence of reaction-promoting ionic species within the plasma. However, this overall process of energy conversion and transfer is accomplished in a relatively inefficient manner and, with few exceptions, is of insufficient intensity or too localized in influence to achieve far-reaching enhancement of the combustion process. Joule heating within the glow or arc phase results from discharge current power dissipation in an already established, highly conductive ionization channel. The power coupling efficiency from a relatively high impedance ignition source circuit to the very low impedance of an established discharge channel is quite low, resulting in a greater fraction of the available energy being lost through power dissipation in circuit resistance other than the discharge channel itself. Somewhat greater power dissipation in the discharge channel can be achieved by increasing the magnitude of current flow. However, for a given discharge duration, this may be accomplished only at the expense of greater energy input requirements and severe electrode wear.

SUMMARY OF THE INVENTION

According to the present invention, a system for initiating the combustion of fuel employs a hard-discharge-ignition (HDI) process which is generated by a very rapid, intense, high-power electrical breakdown which we shall refer to as a "hard" spark discharge. HDI initiation of combustion employs highly effective energy coupling mechanisms which reach high levels of intensity. The term "hard-discharge" as used herein refers to the regime of operation in which the discharge circuit inductance and resistance are sufficiently low that the rate of current flow and rate of energy deposition in the discharge channel during the breakdown phase are largely governed by the resistance of the spark channel itself.

This extreme regime of operation is characterized by highly efficient coupling (80–95%) of the initially stored electrical circuit energy, during approximately the first half-period of the discharge current cycle, into the various transient processes associated with gaseous discharge formation and expansion. As a result, hard-discharge operation delivers most of the available pulse energy within the breakdown phase of the discharge (usually within the first few tens of nanoseconds of the discharge), thereby achieving maximum power coupling from the driving circuit to the rapidly dropping effective load impedance of the discharge channel.

Using typical discharge circuit energy levels of between 0.05 to 2 Joules, and with rates of rise of breakdown current flow on the order of $10^{10}$–$10^{12}$ amperes per second, the resulting power deposition can approach of order of 10's of megawatts within the time span of a few 10's of nanoseconds. Discharges of this type give rise to intense light* emission and strong hydrodynamic blast wave effects in addition to the usual high-temperature thermal plasma volume formation.

*as used herein light is a general term which includes ultraviolet and infrared as well as the visible spectrum of electromagnetic radiation.

The "vacuum" or "hard" ultraviolet portion of the photon flux (with wave lengths equal to or less than 2,000 angstroms) and the hydrodynamic blast wave are, in fact, major energy redistribution and transfer mechanisms which play a primary role in the initial expansion of the breakdown channel. Qualitatively, HDI generates a hard-spark-discharge that gives rise to a rapidly expanding plasma channel in which the generation of a strong, hydrodynamic blast wave is coupled with an intense burst of high-ultraviolet-content light. The shockfront of the blast wave is initially driven, and hence followed by, a high density shell or "piston" of hot plasma which forms the leading ionization front of the expanding discharge channel. At some point during the discharge, usually near the crest of the peak discharge current flow when the plasma channel expansion slows significantly, the shockfront detaches from the driving plasma piston and moves on out at supersonic speed into the surrounding gas.

The intense light emission from the expanding channel is reabsorbed with varying degrees of effectiveness, depending upon the type of gas atmosphere and the radiation wavelength, by the gas layers surrounding the channel. Depending upon wavelength and absorption mechanism, this results in molecular excitation, heating, dissociation, and ionization. These effects occur with intensities that decrease with increasing distance from the source of the photon flux (i.e., the discharge channel), and thus they contribute to the establishment of gradients in temperature, internal energy content, dissociated atomic species, and ionized species that initially extend beyond both the plasma piston ionization front and the forming blast wave shockfront into the immediately surrounding gas layers.

Energy transferred to the combustible mixture by means of shock-induced excitation and radiation absorption causes mixture sensitization, formation of reaction-promoting species, regions of increased temperature and pressure, pre-flame reactions, and micro turbulence. This is further complemented by the subsequent expanding, high temperature plasma volume with its thermal gradient and high-energy ionic species content. The combined, high intensity presence of these multiple energy transfer processes may give rise to synergistic phenomena such as SWACER (shock-wave-amplification-by-coherent-energy-release), which is believed to be an important mechanism in the transition of deflagration (burn) combustion to supersonic detonation combustion. Under the relatively high pressure (5–12 atmospheres), high temperature (500°–800° K.) initial conditions existing in an engine combustion chamber during the latter stages of the compression stroke, this ensemble of HDI energy coupling mechanisms gives rise to a rapid overall combustion event which may consist of a combination of high-velocity turbulent deflagration and supersonic detonation combustion processes. The HDI process is very robust in nature and is capable of extending stable engine operation to ultra-lean fuel mixtures.

Additionally, the greatly enhanced speed of the overall combustion event significantly reduces the amount of ignition timing advance necessary for MBT (maximum brake torque) operation with a given fuel-air mixture. Depending upon the mixture ratio, engine conditions, and HDI energy and power level, the need for timing advance may be entirely eliminated. Consequently, highly efficient engine operation is provided with significantly reduced ignition timing advance, and possibly with ignition at or after TDC.

BRIEF DESCRIPTION OF THE DRAWINGS

In the drawings, which form an integral part of the specification and are to be read in conjunction therewith, and in which like reference numerals are employed to designate identical components in the various views:

FIGS. 4A and 4B are a series of oscillograms of current and light flash intensity of spark discharge in the hard discharge regime;

FIG. 5 is a graph depicting a typical voltage-current characteristic for a gas in a uniform electric field;

FIG. 6 is a diagrammatic view showing the breakdown formation in a gaseous dielectric during low overvoltage conditions;

FIGS. 14C–J are views similar to FIG. 14A but depicting alternate forms of geometry for the firing tip;

FIG. 27 is a combined block and detailed schematic diagram of the combustion initiation system of the present invention employing a mechanical distributor;

FIG. 28 is a combined block and detailed schematic diagram of an alternate form of the combustion initiation system using demand-charging;

BEST MODE FOR CARRYING OUT THE INVENTION

Overview and Characterization of HDI

The rate of admission of energy into the breakdown channel in a spark gap must be maximized in order to achieve high power coupling efficiency and to maximize the intensity of the energy transfer mechanisms which are important in accordance with the present invention for ignition applications. This may be accomplished by using a very low inductance, low impedance, capacitive-discharge driving circuit represented by the simplified equivalent model shown in FIG. 1. As used in this description, the term "driving circuit" refers to all of the high voltage discharge circuit components, connecting conductors, and structures other than the breakdown gap and gaseous discharge path itself. Capacitor C represents the total effective discharge circuit capacitance, inductor $L_o$ represents the total effective driving circuit inductance, and resistance $R_o$ represents the total effective driving circuit resistance. C may be a discrete, lumped-element capacitor connected to the spark gap by means of a low inductance lead configuration, or it can be a distributed capacitance in the form of a very low-impedance, low-inductance waveguide structure which acts as a distributed pulse-forming-network (PFN). With operating voltages typically in the range of 20–40 kv, the magnitude of the capacitor C will fall within the range of approximately 100 picofarads to about 5 nanofarads. $L_o$ includes the inductance of all connecting conductors and the inductance associated with the discrete or distributed capacitive unit and must generally be on the order of a few hundred nanohenries or less. $R_o$ includes the resistance of the circuit conductors as well as the effective resistive loss associated with dielectric losses in the capacitive element. In practice, $R_o$ should be no more than a few ohms, and preferably should be minimized to the sub-ohm level. In general, this approach toward ignition system operation contrasts with the prior art approach which lays heavy emphasis upon higher impedance, higher inductance, lower capacitance driving circuitry and considerably longer discharge duration at lower intensities.

Figure 1:
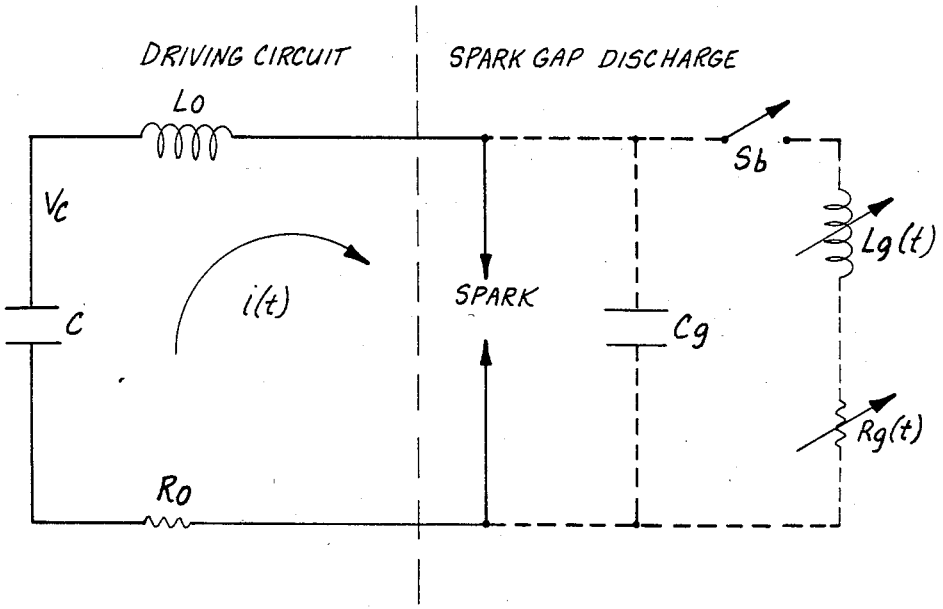
FIG. 1 is a schematic diagram of an equivalent electrical circuit for generating a hard discharge ignition in accordance with the present invention.

The equivalent lumped circuit model components for the spark gap are indicated by dashed lines in FIG. 1. $C_g$ is the capacitance of the gap prior to breakdown and is typically on the order of 10 picofarads (10 pf). $C_g$ is important for storing the charge needed during the very early stages of the breakdown channel formation, but the magnitude of Cg is small compared to C and can be neglected once the early breakdown channel has been established. Closing of switch $S_b$ represents the onset of the breakdown event in which an ionized current flow path is formed between the spark gap electrodes.

The detailed mechanisms involved in this process depend upon the conditions of the gas in the gap and the manner in which the voltage is applied. For purposes of this disclosure, it may be assumed that the establishment of current flow across the gap may be represented by the closing of a switch $S_b$. $C_g$ is then effectively shunted by the time-varying channel inductance $L_g(t)$ and resistance $R_g(t)$. The circuit operation begins after capacitor C is charged to an initial voltage $V_o$ which is of sufficient magnitude to initiate the breakdown process of the discharge gap. The charging circuit (not shown in FIG. 1) is assumed to be sufficiently isolated from the discharge circuit to have negligible influence on its operation. At the time of initial breakdown (t=0), a conductive channel in the gap is formed (i.e., switch $S_b$ closes) and current i(t) begins to flow in the discharge circuit. In fact, the initially formed breakdown channel in a spark discharge can have appreciable current flow associated with it at the instant that the gap is bridged (t=0). Neglecting the time-varying character of $L_g$ and $R_g$, or assuming they are negligibly small compared to $L_o$ and $R_o$, the discharge current may be approximately described by the formula $$I(t)=(V_o/L\omega)e^{-\alpha t}\,\mathrm{Sin}\,\omega t, \tag{1}$$

where $$\alpha=R/2L, \omega^2=(1/LC)-\alpha^2,$$

$$R=R_o+R_g,$$

and $$L=L_o+L_g.$$

Taking the derivative of equation (1) provides $$dI/dt=(V_o/L\omega)e^{-\alpha t}\,\mathrm{Cos}\,(\omega t+\zeta), \tag{2}$$

where $$\zeta=\tan^{-1}(\alpha/\omega). \tag{3}$$

From this it follows that the maximum rate of rise of discharge current flow is at time t=0 and is given by $$\left.\frac{dI}{dt}\right|_{max}=\frac{V_o}{L}, \tag{4}$$

where L is some constant total effective discharge circuit inductance and $V_o$ is the initial charge voltage. Equation (4) above, with L taken to be approximately $L_o$, often forms the initial condition for solutions of spark discharge current flow and is typically taken to be the value of steepest current rise during discharge operation. However, the condition given by equation (4) is an upper limit approximation which will be approached to the extent dictated by the "hardness" or "softness" of the actual discharge.

The "hardness" parameters of an actual discharge may be characterized as follows:

$$\phi=\frac{\left.\frac{di}{dt}\right|_{max}}{V_o/L}\leqq 1, \tag{5}$$

$$=\frac{1}{\phi}=\frac{V_o/L}{\left.\frac{di}{dt}\right|_{max}}\geqq 1, \tag{6}$$

where $V_o/L$ $V_o/L$ is the upper limit condition of equation (4), and $$\left.\frac{di}{dt}\right|_{max}$$

is the actual maximum rate of rise of current flow attained in a real discharge circuit. Thus, where phi and psi are very nearly equal to unity and discharge is "soft" whereas hard discharge operation in accordance with the present invention is achieved when phi is less than one and psi is greater than one. The "harder" the discharge the greater phi and psi depart from unity.

Closer examination of the time-dependent equation which describes the bahavior of the circuit shown in FIG. 1 provides a better understanding of hard-discharge phenomena and the significance of the conditions given in equations (5) and (6). The voltage equation for FIG. 1, upon closure of switch $S_b$ at time=o, takes the form $$V_o - \frac{1}{C}\int_o^t i(\tau)d\tau - L\frac{di}{dt} - \frac{i}{2}\frac{dL}{dt} - Ri = 0, \quad (7)$$

where $L(t)=L_o+L_g(t)$,
and $R(t)=R_o+R_g(t)$.

Considering very early times only, and neglecting all but the dominant terms in equation (7) at early time gives the first order approximation $$L(di/dt)+Ri \approx V_o. \quad (8)$$

The commonly used condition of equation (4), which characterizes soft-discharge operation, is seen from equation (8) to arise when the resistive voltage drop in the discharge circuit is negligibly small relative to the inductive voltage drop. However, in a gaseous discharge circuit employing a very low inductance ($L_o$), low resistance ($R_o$) driving circuit, the magnitude of early-time current flow cannot be neglected. The resulting resistive voltage drop, which is predominately due to the initially high but rapidly falling active resistance of the early-time breakdown channel, can be a major factor that can actually dominate over the inductive voltage term. From equation (8) it follows that $$\Phi \approx \left\{ 1 - \frac{R(tm)i(tm)}{V_o} \right\}, \quad (9)$$

where $t_m$=time of maximum di/dt which demonstrates that hard-discharge operation occurs when the drive circuit inductance and resistance are so low that the rate of rise of current flow is largely governed by the resistance of the discharge channel itself. Using a truncated power series in time (t) as an approximation for i(t) at early time, it can be shown that, for the discharge circuit shown in FIG. 1

$$\phi \approx \frac{L/lg}{\frac{tm^2}{4Clg} + \frac{2Rmtm}{3lg} + \frac{L}{lg} - 1}, \quad (10)$$

where tm is the time at which the rate of rise of current flow is maximum (nanoseconds)

Rm is the discharge channel resistance at time tm (ohms),

C is capacitance (nanofarads),

L is inductance (nanohenries), and lg is gap length (centimeters).

From experimental observations reported in the literature, the following experimental approximation of channel formation time can be obtained:

$$tm \approx 425P^{\frac{1}{2}}/Z_o^{\frac{1}{3}}E^{1.1}$$

where $t_m$ is in nanoseconds $Z_o$ is drive circuit impedance in ohms, $E_o$ is breakdown field in kv/cm, and P is ambient gap pressure in atmospheres.

Figure 3:
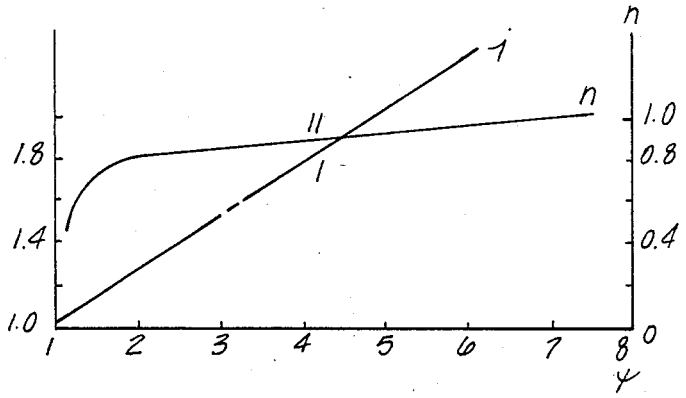
FIG. 3 is a graph showing the degree of aperiodicity and the fraction of total energy deposited during the first half-period of current flow for hard discharge operation, as a function of the hardness parameter.
Figure 2A:
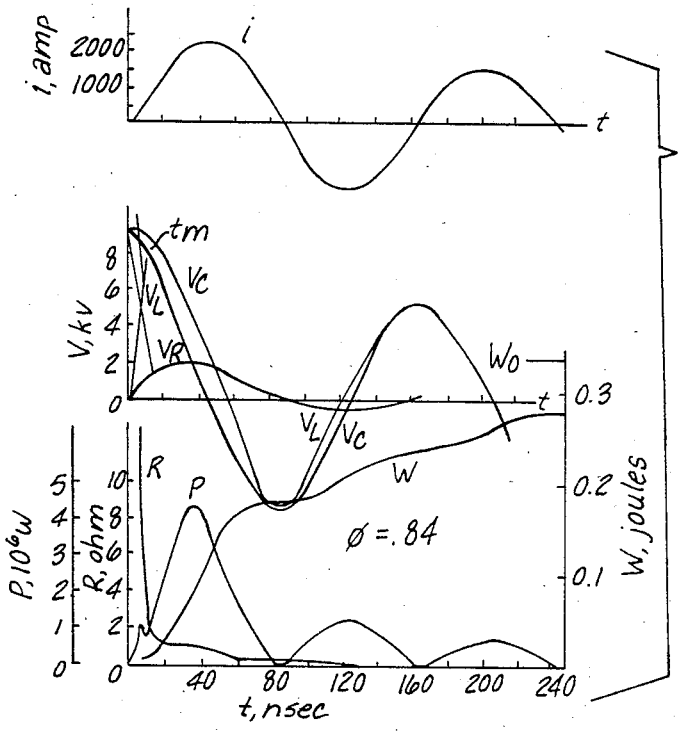
FIGS. 2A and 2B are a series of graphs respectively displaying the electrical characteristics of spark discharge operation in a marginally hard discharge regime and a much harder discharge regime.
Figure 2B:
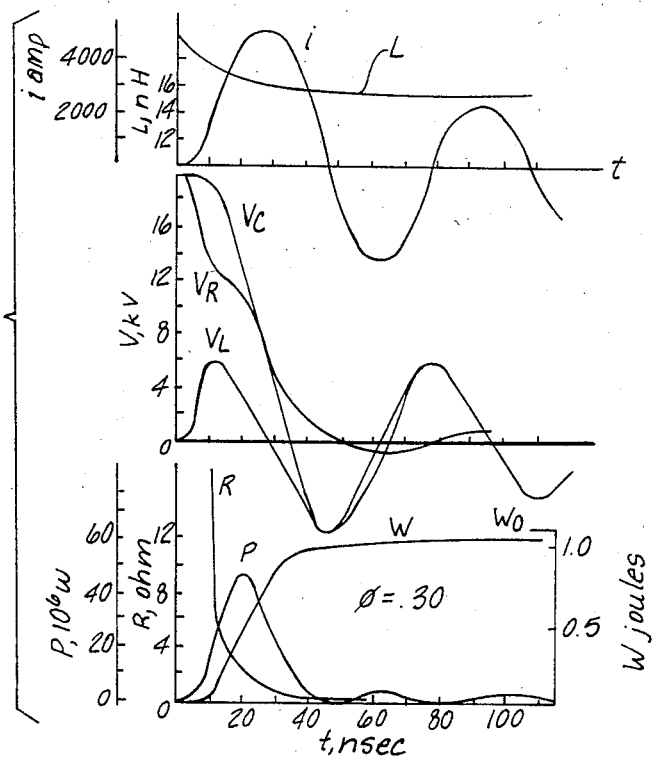
Figures 7A, 7B, 7C, 7D, 7E, 7F:
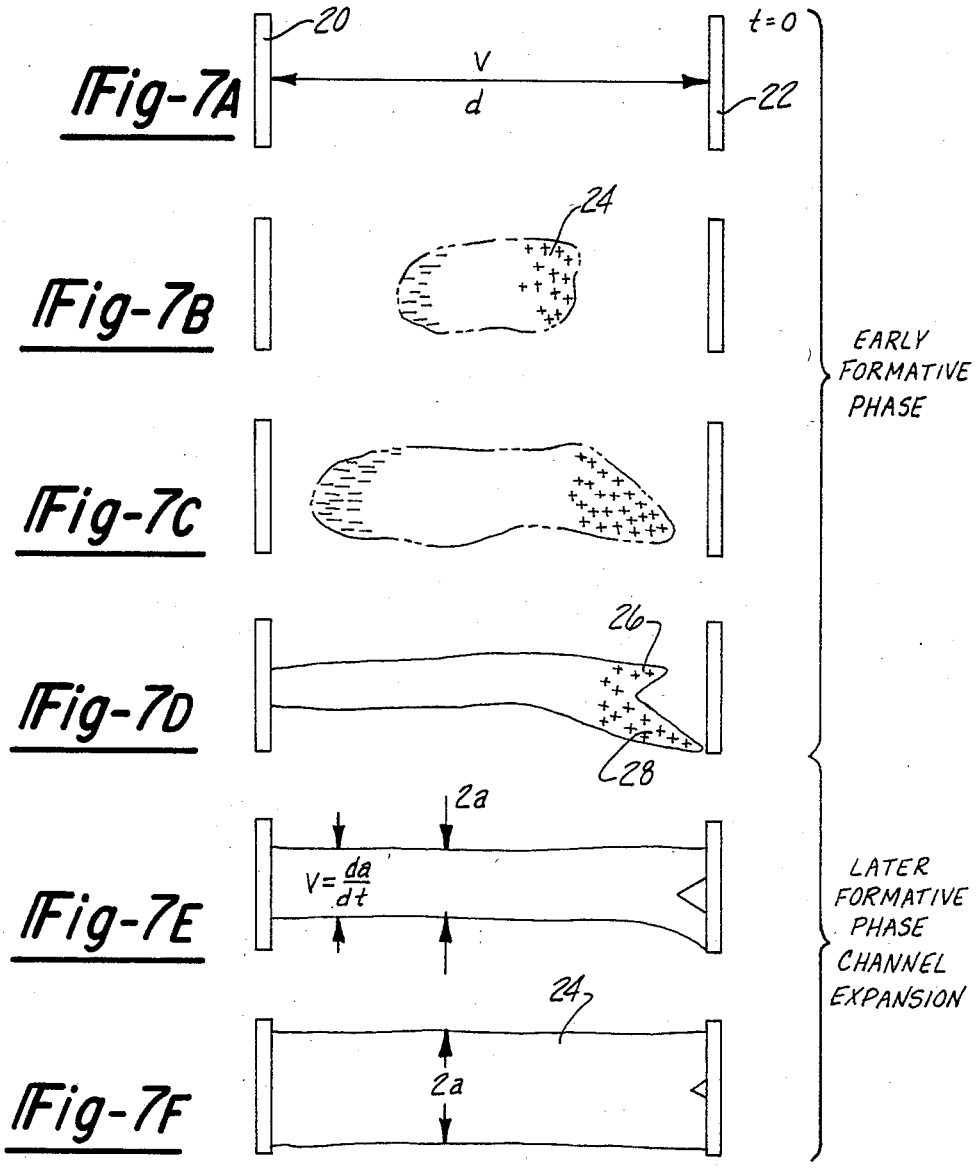
FIGS. 7A–7F are diagrammatic views showing successive phases of an electrical discharge in a gaseous dielectric in high overvoltage conditions.

The character of hard discharge operation is shown in FIGS. 2–4, which are based on open air experimental observations made during the early 1960's by the Russian investigators S. I. Andreev and M. P. Vanyukov. FIG. 2A displays operation in the marginally hard discharge regime (phi=0.84) while FIG. 2B depicts much harder discharge operation(phi=0.3). In these figures, i is the discharge current flow; $V_c$, $V_L$, $V_R$ are the voltages across the circuit capacitance, inductance, and resistance, respectively; R, L are circuit resistance and inductance; P, W are the rate of energy release in the discharge channel and the amount of total energy released in the discharge, respectively; and $t_m$ is the time of maximum rate of rise of current flow. As can be seen from the curves in FIGS. 2A and 2B, harder discharge current flow becomes more aperiodic, (broadening of first half-period of current flow) relative to subsequent half-cycles), with a greater fraction of total energy ($W_o$) deposited during the first current lobe.

These two distinguishing characteristics are more readily apparent in FIG. 3 wherein the degree of aperiodicity shown in curve I and the fraction of total energy deposited during the first half-period (lobe) of current flow (curve II) are plotted as a function of the hardness parameter psi=phi$^{-1}$. The function j depicted in Curve I is the width of the first half-period of discharge current flow relative to the eseentially constant widths of subsequent half-cycles. The function n depicted in Curve II is the ratio of the energy deposited (dissipated) in the discharge circuit (primarily in the active resistance of the discharge channel) during the first half-period of current flow relative to the total energy ($W_o$) initially available. FIG. 3 demonstrates that operation with phi less than or approximately equal to 0.5 deposits more than 80% of the initially stored energy into the discharge during the first half-period of current flow.

Conversely, the transition region where psi is greater than 0.5 but less than or equal to 1 is characterized by a rapid decrease in the fraction of first lobe energy deposition as the discharge operation becomes softer (i.e. as phi and psi approach unity). As operation gets progressively harder than phi approximately equal to 0.5, the fraction of first lobe energy deposition moves gradually from about 80% toward 100%. This is accompanied by increasing aperiodicity and a reduction in overall discharge duration with increasing hardness, until finally the discharge current flow becomes effectively critically damped. In this totally aperiodic regime, virtually all of the available energy is deposited in the discharge during the first, considerably broadened, current lobe with the result that no subsequent half-cycles arise, and the overall discharge duration is approaching a minimum.

FIG. 4 demonstrates the effect of hardness on the aperiodicity and broadening of the first lobe of discharge current. Also evident is the effective shortening of the overall duration of the discharge current flow as hardness increases. FIG. 4 also shows the increased magnitude of the intensity and duration of the disclosure induced light flash which accompanies both increased hardness and increased energy level.

For ignition applications of HDI, maximum performance is obtained with operation in the region of phi approximately equal to or less than 0.5, and psi equal to or greater than 2, which follows directly from the high power dissipation achieved by delivering 80% or more of the available energy within the breakdown phase during the first discharge current lobe. Using voltages from between 20 KV to 40 KV, and discharge circuit capacitance of 100 picofarads to several nanofarads, hard discharge operation requires values of $L/l_g$ on the order of a few hundred nanohenries of discharge circuit inductance(L) per centimeter of discharge gap length ($l_g$), or less. Operation in the region of phi approximately equal to or less than 0.5 typically requires $L/l_g$ approximately equal to or less than 80 nanohenries per centimeter, depending on the value of capacitance C and the effective working gap breakdown electric field $E_o$.

As a practical matter, reducing the overall circuit inductance to values of $L/l_g$ below approximately 10 nH/cm is quite difficult in high voltage discharge circuits where certain minimum physical spacing is required for electrical insulation. In fact, the breakdown channel itself typically has self-inductance on the order of 10 nH/cm. In cases where insufficient hardness has been achieved despite the minimization of $L/l_g$ to practical limits, the major alternatives for increasing hardness are to decrease the capacitance C and/or to effectively increase $E_o$ by overvolting the discharge gap. Investigations with hard (phi equal to or less than 0.3) open air discharges have shown that for values of C less than or approximately equal to 3 nanofarads, an increase in energy caused by increasing the working voltage $V_o$ and gap length $l_g$ yields a shorter discharge current duration and a longer duration of light output with light output in very hard discharges (phi equal to or less than 0.2) continuing well beyond the cessation of current flow (afterglow). If constant energy $W_o$ is maintained by reducing C while increasing $V_o$ and $l_g$, the total discharge duration is again reduced. Hence, for sufficiently small capacitance C (approximately equal to or less than 3 nanofarads) increased discharge power output is obtained by increasing the working voltage $V_o$ and the gap length $l_g$. Experimentation has shown that optimum discharge conditions in terms of the rate of energy release and light output intensity, occur when most of the available energy is liberated before the time $t_{cr}$ when the resistance of the spark channel drops below the critical value, given by $$Rg(t = t_{cr}) = R_{cr} = 2\sqrt{\frac{L_o}{c}} = 2\,Z_o \tag{13}$$

Under these conditions, the discharge current flow is highly aperiodic in character with a total duration approximately equal to the first half-period pulse width.

The criteria for obtaining optimum aperiodic discharge in which most of the available energy is deposited within a time frame less than $t_{cr}$ are given by the equations:

$$\sqrt{Clg} \leqq \frac{t_{cr}}{j\pi\sqrt{\frac{Lo}{lg} + \hat{L}}}, \tag{14}$$

$$\sqrt{\frac{Wo}{lg}} \leqq \frac{E_o t_{cr}}{j\pi\sqrt{2(Lo/lg + \hat{L})}}, \tag{15}$$

where $\hat{L}$ is the inductance per unit Length of the discharge channel itself, and j is the broadening factor shown in Curve I of FIG. 3 for the first lobe of discharge current flow.

$E_o$ increases with pressure according to the paschen curve for a given gap configuration and is also dependent on the rate at which voltage is applied to the gap. Similarly, the critical time $t_{cr}$ for a particular gap configuration in air depends on pressure, breakdown field ($E_o$), and the effective impedance $Z_o$ of the circuit driving the discharge gap. Experimental results with very hard, linear gap, open air discharges under low overvoltage conditions for which $E_o \sim 25$ KV/cm, $t_{cr} \sim 20$ nsec, and $j \sim 2.2$ have shown that under such conditions the optimum criteria for achieving effectively critically damped aperiodic discharge are approximately $$Clg \lesssim (Clg)_{max} \approx 840[\text{pf.cm}], \tag{16}$$

$$Wo/lg \lesssim (Wo/lg)_{max} \approx 260[mJ/\text{cm}]. \tag{17}$$

With differing gap geometry under higher pressure conditions with hydrocarbon fuel present in the air mixture, such as experienced in an engine combustion chamber, the values given by equations 16 and 17 may change to an extent that cannot be readily predicted without consideration of the parameters unique to the gap configuration, rate of voltage application, and chamber environment.

The rate of rise of the voltage applied to the gap can affect the dynamics of the breakdown process. With sufficiently rapid voltage application, a given gap can be "overvolted" and the resulting effective breakdown field $E_o$ can be significantly higher than the field attained under slower voltage rise conditions. However, for a given gap configuration operated in a specific ambient environment with known discharge circuit parameters at a fixed rate of voltage rise, optimum criteria as given by equations (14)–(17) exists for obtaining totally aperiodic, hard discharge operation. When $Cl_g$ is then greater than $(Cl_g)_{max}$ or $W_o/l_g$ is greater than $(W_o/l_g)_{max}$, the discharge becomes oscillatory and its overall duration increases. For small values of $L/l_g$, the overall discharge duration will remain relatively brief, even though oscillatory. Open air experiments have shown that for situations where hard discharge operation is nearing optimum, but is still in the oscillatory regime, the duration of light flash changes relatively little for $$30\ \eta H/\text{cm} \lesssim L/lg \lesssim 10\ \eta H/\text{cm}. \tag{18}$$

Although the specific hard discharge criteria and conditions for optimum discharge performance will vary depending upon the particular circuit parameters and operating conditions, the estimates given hereinabove for open air experimental investigations give a reasonable order of magnitude approximation that can be considered generally characteristic of hard discharge operation.

The discharge channel, as referred to in this disclosure, is the transition region wherein the electrical energy is released within the combustible air-fuel mixture. The various coupling mechanisms transfer energy to the fuel charge for initiation of the chemical reaction. The description of the processes involved in the initiation may be grouped into three main areas: channel formation, channel expansion, and combustion initiation.

Numerous theories have been proposed in the past to describe the detailed mechanics of channel formation. These include the Townsend model, Streamer model, Avalanche model and continuous acceleration model. These models are variously applicable within specified domains of overvoltage and gap field enhancement. Although the mechanisms involved in the breakdown process are quite complicated and not fully understood, the process may be briefly described as follows.

Reference is now made to FIG. 5 which depicts a typical voltage-current relationship for a gas in a uniform electric field. An electric field may be established between two electrodes by applying a voltage across the gap therebetween. As the applied voltage rises, electrons and ion species are generated in the gas within the gap. If these species are generated at a rate greater than the recombination rate, then the species will move toward their respective electrodes at specified speeds (drift velocities). The drift velocity of electrons is much higher than ion velocities due to the large differences in the masses thereof. As the electrons and ions move through the gas between electrodes, they undergo collisions with neutral atoms which cause additional, secondary ionization and thus an increase in the ion density of the gap.

This multiplication process continues and the effective current flow increases until the breakdown point is reached where a sharp drop in voltage across the gap usually occurs and is accompanied by a large increase in current density and overall current magnitude. The details of this process depend upon the nature of the gas, the pressure and the rate of voltage application.

The breakdown of a spark gap occurs when the voltage applied across the electrodes reaches a minimum level such that the electric field strength in the gap exceeds the minimum threshold necessary to generate and accelerate charge carriers at a rate which precipitates the multiplicative growth of the process. Application of voltage above this minimum threshold "overvolts" the gap and causes breakdown. Upon establishment of the minimum breakdown field, the inception of the breakdown process requires the elapse of a brief but non-zero amount of time. The time delay from minimum breakdown voltage application until the beginning of the voltage collapse that accompanies breakdown formation is normally termed the "time-to-breakdown". The processes which initiate breakdown are governed by statistical laws, multiplicative growth rates, and transit times which depend on gap length and field strength. For this reason, time-to-breakdown is a variable quantity which is responsible for "jitter" in spark gap firing. "Statistical delay time" is a useful number which is the mean of the distribution of times-to-breakdown for a given gap situation. Statistical delay times can range from tens of nanoseconds to hundreds of microseconds depending on gap geometry, gap length, gas atmosphere, pressure, level of initial charge carrier density, and rate of voltage application. If voltage is applied rapidly enough, the peak voltage attained during the delay period prior to the onset of breakdown may reach well beyond the minimum breakdown voltage threshold. This high overvoltage condition increases the electric field strength which in turn can influence the dynamics of the breakdown process. As used in this disclosure, "overvolting" of a gap will generally refer to the application of significantly higher (perhaps 20%) voltage than the minimum breakdown threshold, and implies a relatively rapid rate of voltage application.

FIG. 6 depicts breakdown behavior based on the growth of a single electron-precipitated avalanche which undergoes transition into the streamer mode. These modes differ physically in that the avalanche is invisible while streamers are marked by photo-ionization and photo-emission which make them brightly luminous. Also, avalanches are believed to propagate at about $10^7$ cm/sec while streamers have typical velocities of $10^8$ cm/sec or greater.

FIGS. 7A–7F display the successive stages in the generation of an electrical discharge between a pair of electrodes 20,22 under conditions of high overvoltage associated with a rapid rate of voltage application. When a voltage is applied to the electrodes 20,22 an electrical field is created which produces ionization of the volume between electrodes. The electric field results in the migration of ions to the positive electrode 20 and of the positive ions to the negative electrode 22. This ion migration continues until the entire length between electrodes 20,22 has been traversed by the ion flow at which time breakdown occurs and a flow of electrical current between the electrodes 20,22 results. The cathode front of the ion volume 24 moves at one velocity toward the positive electrode (anode) 20 and the anode front moves toward the negative electrode (cathode) 22 at a velocity lower than that of the cathode front. The cathode front tends to have a single head while the anode front may possess several heads 26, 28.

Regardless of the exact mechanisms involved, at some point in time a column or "channel" of heated, ionized plasma forms a complete path between the electrodes 20,22. This newly formed ionized channel is typically approximately 0.05 mm to 0.1 mm in visible diameter and has associated with it an initial non-zero current flow which can approach several hundred to several thousand amperes in magnitude. For temperatures below about 12,000° K., the conductivity of a gas is highly dependent upon temperature. Thus, the hotter regions of the initial ionized column present the easiest path for subsequent current flow. The increasing current flow through the hotter regions of the still relatively resistive plasma channel causes rapid joule heating which results in increased plasma temperatures that in turn increase the plasma conductivity. This positive-feedback process rapidly leads to the production of very high internal pressure within the channel which brings about the initially explosive process of channel expansion and eventually leads to a decrease in the effective resistance and inductance of the discharge path.

For the specific case of a breakdown channel in air with early current flow I(t) proportional to time, the radius of the channel may be expressed approximately from Braginskii's theory as:

$$a(t) \simeq .93 \frac{I(t)^{1/3} t^{1/2}}{\rho^{1/6}} + a_o, \tag{19}$$

where a is the channel radius in millimeters (mm) at time t,
I is channel current flow in kiloamperes,
t is in microseconds,
rho is the density of air in units of g/cm$^3$, and
$a_o$ is some initial non-zero channel radius in mm at the instant of channel formation at t=0.

Taking the time derivative of equation (19) yields:

$$V(t) = \dot{a}(t) = \frac{.31 t^{1/2}}{\rho^{1/6} I(t)^{2/3}} \left[ \dot{I}(t) + \frac{3}{2} \frac{I(t)}{t} \right]. \tag{20}$$

From equation (20) it is apparent that the radial velocity of expansion of the channel is a function of both the current magnitude and the rate of rise of current. The rate of channel expansion may be maximized in accordance with the teachings of the present invention by very low inductance, high speed, high current, high power deposition hard-discharge operation.

Channel expansion rates on the order of tens of kilometers per second have been observed in rapid, high current, hard spark discharges. At these rates of channel expansion, a significant shock wave is generated. The maximum shock energy generated under these conditions is given approximately by:

$$W_s \simeq 6.8 \times 10^{-4} \frac{V^{4/3}}{Z^{3/4}} (d) \left( \frac{1}{CR} \right)^{\frac{2}{3}}, \tag{21}$$

where $W_s$=the overall cylindrical shock wave energy content in joules,
V=Effective Breakdown Voltage (volts)
Z=Discharge Circuit Impedance, $(L/C)^{\frac{1}{2}}$ (ohms)
d=Arc Gap Length exposed to the fuel (meters)
CR=Ratio of initial pressure to ambient pressure (compression ratio)

Similarly, the maximum velocity of the shock wave is given approximately by $$V_s \simeq 3.11 \times 10^{-2} \left[ \frac{V}{l_g^{2/3} Z^{1/6}} \right] \left[ \left( \frac{1}{CR} \right)^{5/12} \right], \tag{22}$$

where $V_s$ is the shock velocity in meters per second, and where $l_g$ is the total effective breakdown gap length in meters.

As previously discussed, the effective breakdown voltage is a variable parameter governed by electrode geometry, ambient pressure, rate of rise of applied voltage, and discharge gap length.

Numerous energy transport phenomena emanate from the arc channel, and these phenomena collectively form an ensemble capable of establishing, within the chemically reactive fuel mixture, an outwardly increasing gradient in the effective reaction induction time. Such a gradient (reaction time increasing with radial distance from the discharge) is capable of giving rise to the synergistic SWACER mechanism of reaction energy release. HDI, according to the present invention, may be further capable of establishing a stimulated-SWACER type of synergism which we shall term SWASER. The SWASER (shock-wave-amplification-by-stimulated-energy-release) mechanism combines physical and chemical energy transport phenomena in a synergistic manner to not only provide the conditions for, but also then stimulate, the coherent energy release from an induction-time gradient, thereby affording substantially increased energy coupling efficiency to the mixture and promoting rapid combustion phenomena. Such an HDI-generated synergistic energy release mechanism would be capable of producing a supersonic detonation shock wave by virtue of an induction time gradient-induced positive-feedback mechanism in which chemical reaction energy is released in phase with the passing, developing wave.

HDI operation not only establishes strong gradients in the chemically reactive mixture, but also provides additional means of stimulating those gradients into the initiation of a rapid combustion process. Specifically, various gradients established through energy transfer by radiation absorption in the layers of gas immediately outside of the expanding discharge channel are soon subjected to the strong shockfront of the blast wave created during the explosive phase of channel expansion. This is followed sometime later by the arrival of the hot plasma kernel and its associated thermal gradient and high-energy ionic species content.

As mentioned above, the energy transport phenomena couple energy to the adjacent gases, thereby elevating their level of excitation and establishing an effective gradient in the reaction induction time which is a function of the radial distance from the surface of the arc channel. As the channel expands outwardly, it reaches a radius and point in time where the shock wave detaches itself from the channel boundary and propagates through the adjacent gases at supersonic speed.

During this highly nonlinear breakdown phase, which characterizes the regime of HDI operation and energy deposition, the shock wave and the intense radiation are the primary mechanisms of energy transport to the fuel charge for mixture sensitization and combustion initiation. During and subsequent to the radiation burst, the shock wave driven by the explosive expansion of the ionization front of the high density plasma shell "piston" is assisted in its growth by hard-UV absorption at the outer ionization front of the channel. This promotes further ionization which aids in the rapid radial; expansion of the ionization front, thereby strengthening and/or sustaining the blast wave shockfront. As the shockfront develops and eventually detaches from the driving plasma piston, it travels through the immediately surrounding layers of reactive mixture which have also been pre-sensitized by the absorption of earlier radiation.

It is believed that the initial gradient established by the radiation preceding the shock wave is itself capable of initiating chemical reactions. The shock proceeds through these gases imparting additional energy thereto and further elevating to varying levels of excitation the gases encountered until it reaches areas of gases which are below the reaction threshold. At this time, the shock is reinforced by pressure waves generated behind the shock from the reactions initiated by the radiation and passing shockfront. This sequence of events then establishes a self-sustaining, shock wave initiated, combustion reaction. Although these processes are not entirely understood quantitatively, it is believed that a sufficiently strong shock alone can be sufficient to initiate the combustion process from the boundary of the channel. The radiant emissions may merely assist the shock process in near proximity to the channel.

If neither the radiation nor the shockfront, individually or in combination, are sufficient to directly initiate self-sustaining combustion reactions, then subsequent phenomena associated with the expanding plasma kernel can initiate reactions that are then capable of rapid acceleration through the surrounding fuel mixture which has been locally sensitized as previously described. In addition to the ionic species and steep thermal gradient of the plasma kernel, microturbulence effects brought about by intense channel expansion and hydrodynamic instability help promote the early development of rapid turbulent deflagration in the already sensitized reactive mixture. Depending on local conditions, the turbulent deflagration combustion mode can rapidly accelerate, and may actually undergo a deflagration-to-detonation transition (DDT).

Figure 8:
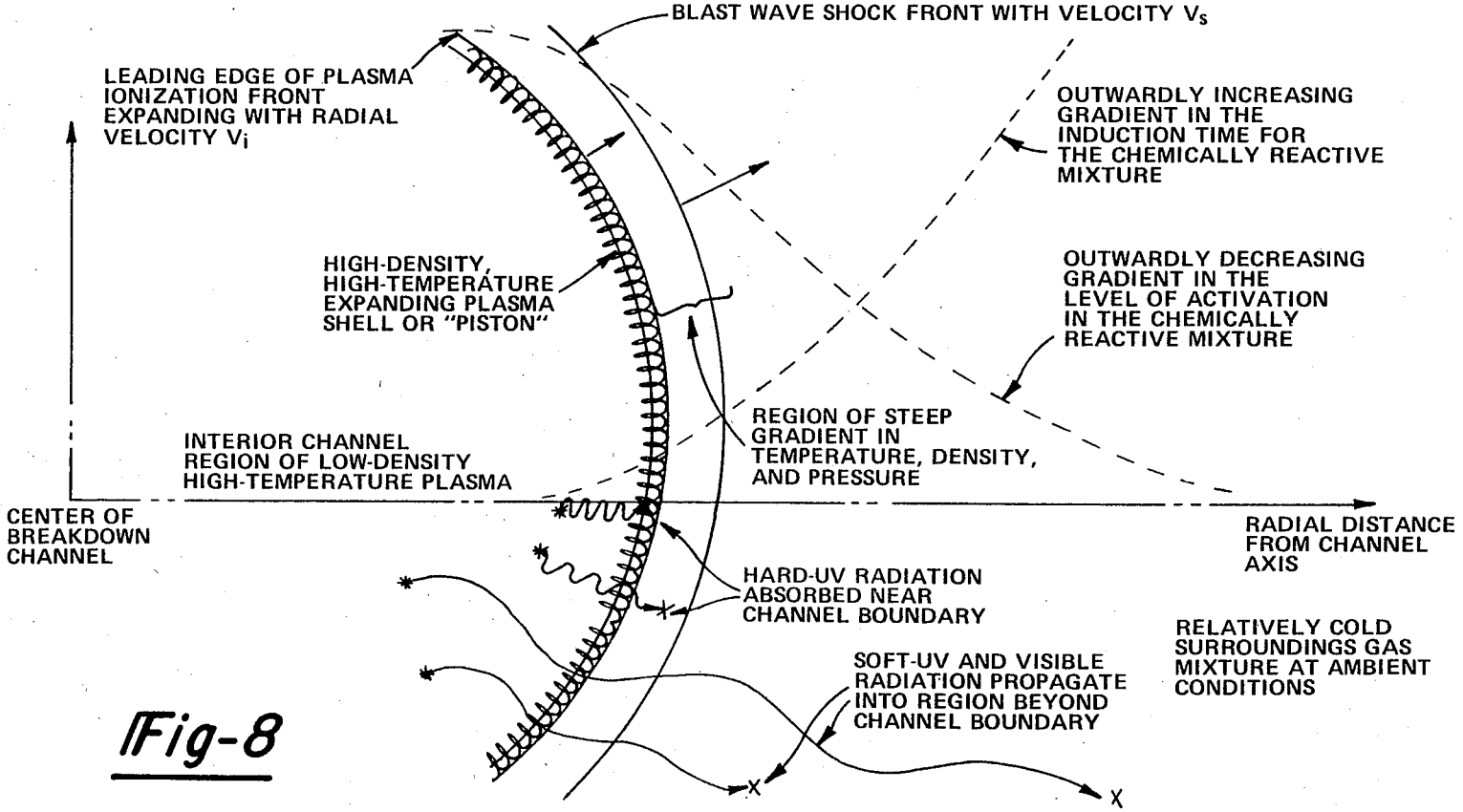
FIG. 8 is a diagrammatic cross-sectional view of an expanding spark discharge channel in a chemically reactive mixture depicting the major HDI energy transfer mechanisms.
Figure 9:
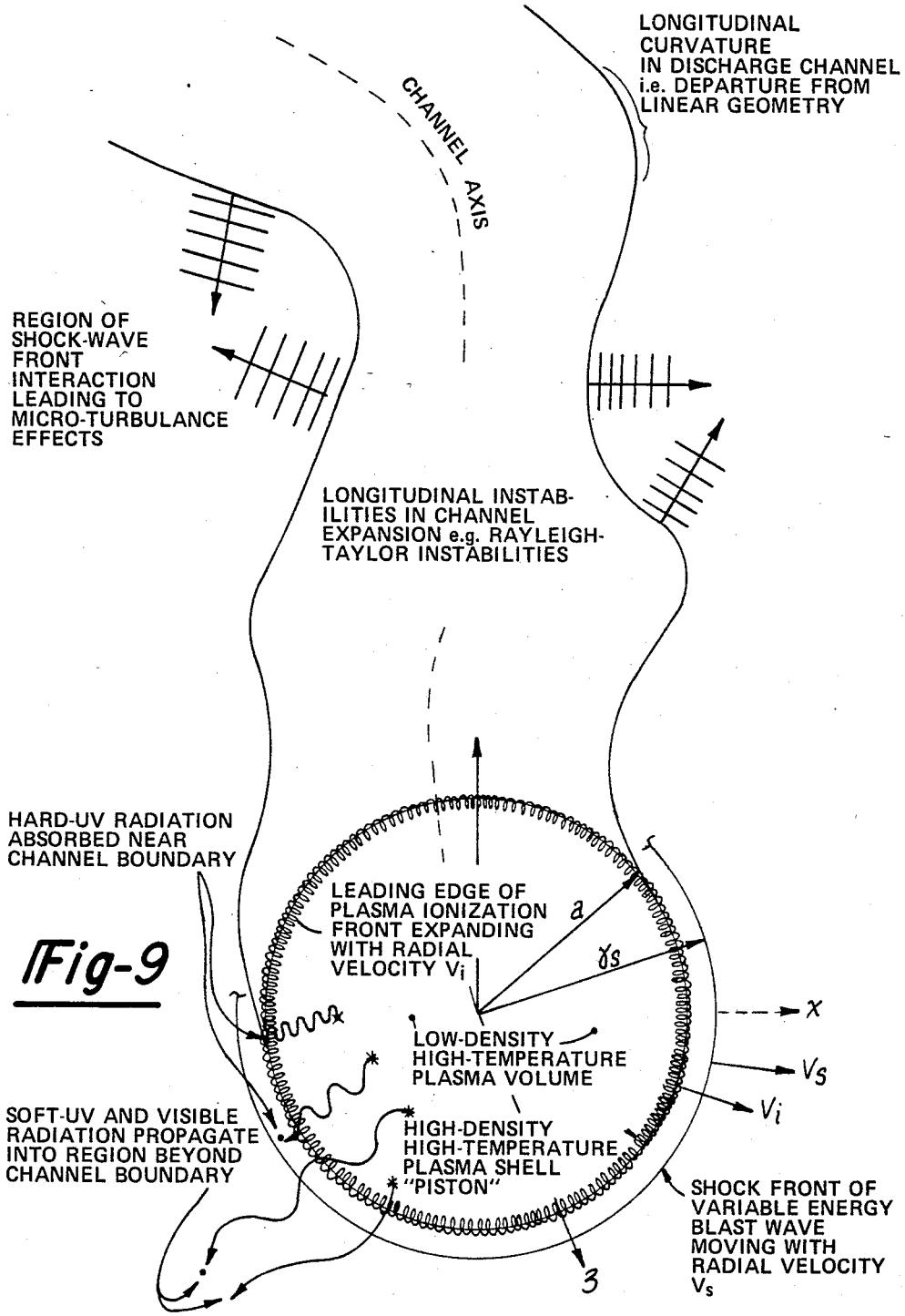
FIG. 9 is a simplified diagrammatic view of the expanding spark channel shown in FIG. 8, also showing a portion of the longitudinal extent of the channel.

FIGS. 8 and 9 depict highly idealized qualitative views of the discharge channel expansion processes within a chemically reactive mixture.

The reaction flow associated with detonation and deflagration combustion have been under continual study for nearly a century. The Hugoniot relationships and plots give the state of any gaseous fluid at various energy levels. Chapman and Jouguet, using these relationships, established that stabilized linear reacting flows with defined "fronts" have two, and only two, stable velocities: one supersonic (detonation) and one subsonic (burn). These velocity states are known as the "Chapman-Jouguet" (CJ) points. A shock wave moving through an explosive medium for a minimal amount of time (induction time) will induce a reaction which will continue through the fuel.

Figure 10:
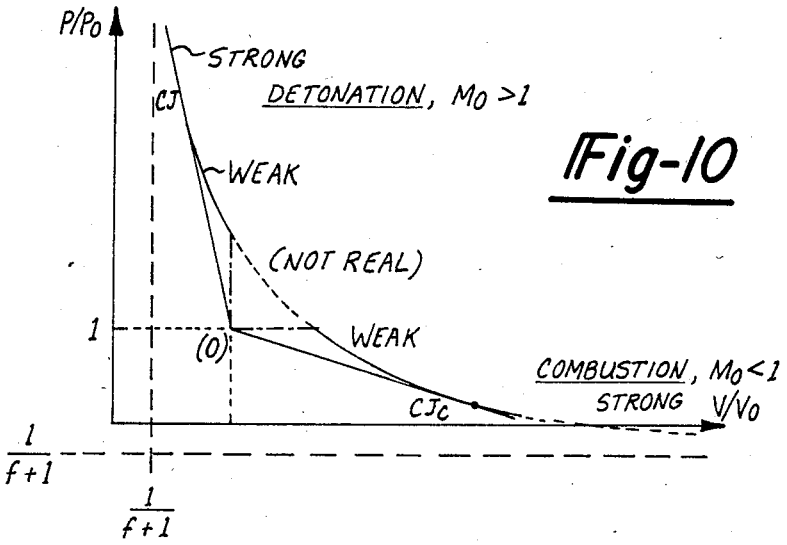
FIG. 10 is an equilibrium Hugoniot curve.

A typical Hugoniot curve is depicted in FIG. 10. The points noted on this curve correspond to the speed at which the combustion reaction propagates through the fuel mixture. These speeds can be expressed as a mach number which is a non-dimensional parameter corresponding to the speed of the propagating reaction relative to the speed of sound in the medium. Reactions occuring on the lower combustion branch are in the subsonic burn region with mach numbers less than or equal to 1. Reactions on the upper detonation branch are in the supersonic region of combustion and have mach numbers greater than 1. The region between the two stable CJ points is usually termed "deflagration". Under typical ambient conditions, within an engine combustion chamber, the detonation CJ point for a stoichiometric mixture of gasoline and air is between about mach 2.5 and mach 2.8. The auto-ignition point is located above the detonation CJ point and is believed to correspond to approximately mach 4 under ambient engine conditions.

The induction time is governed by physical laws which state that the rate at which certain species will react depends on their relative concentrations, energy distributions, and the probabilities that species of given energy levels will contact and react.

Because of the viscous effects of the fluid, the strength of a shock wave is reduced as it propagates through a non-reactive mixture. Consequently, an unassisted shock wave must attain a velocity greater than CJ to insure the initiation of the release of chemical energy to reinforce the weakening shockwave before the frontal velocity falls below the minimum necessary to initiate reaction. This is referred to as the "Auto-Ignition" limit.

Figure 11A:
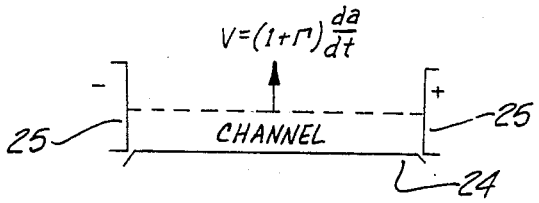
FIGS. 11A and 11B are diagrammatic views showing channel expansion velocity enhancement due to reflection of expanding channel boundaries from rigid structures and direct interaction of adjacent expanding channel boundaries.
Figure 11B:
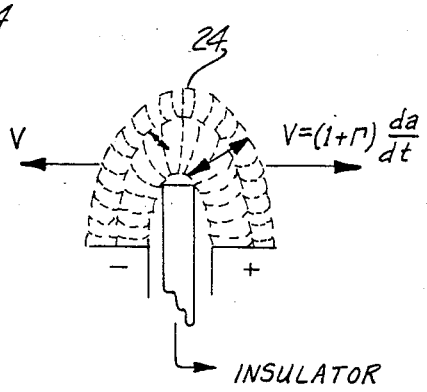

Investigation of ignition by radiation, or "photolysis", has shown that radiation absorption can lead to a reduction in the effective induction time in a chemically reactive mixture. Hence, the presence of intense radiation may yield a decrease in the effective Auto-Ignition limit, thereby reducing the necessary shock strength required for the establishment and propagation of a steady-state supersonic detonation reaction flow. "Hard discharge" according to the present invention optimizes these effects. In addition, by proper orientation of the discharge geometry, additional physical enhancement may be achieved in radial shock velocities and microturbulence effects by the interaction of the arc channel 24 with rigid structures 25 (FIG. 11A) or from the direct interaction of adjacent expanding channel boundaries (FIG. 11B). Enhanced plasma particle projection or jet action may also be promoted with breakdown gap geometries which establish curvature in the breakdown electric field lines, and/or which provide small cavity-like recesses that cause focused reflection of expanding channel boundaries and directional confinement of high-pressure plasma volume.

We have found that the HDI method has a high energy transfer efficiency during the very early times of discharge channel formation and expansion. If the total system is tailored such that most of the available electrical energy is dissipated in this breakdown phase of the discharge, then peak power coupling will result. Because a major portion of the total energy is distributed in the plasma channel and the adjacent gases in a relatively brief time frame, (on the order of tens of nanoseconds) less energy in the form of heat is retained at the electrodes. Thus, a major factor in electrode wear is reduced. Some electrode wear caused by rupture phenomena will occur, however the severe melting erosion found in relatively long duration, high energy arc discharge operations is greatly reduced.

As previously mentioned, using a higher operating voltage $V_o$ maximizes hard discharge performance by maximizing the gap length (lg) and, for a given inductance (L), minimizing the ratio L/lg. Operating with higher voltages is also preferred for reducing electrode wear. It is well known in the art that electrode erosion is generally proportional to the amount of charge transfer per discharge. For a given amount of pulse energy supplied to the electrodes, the amount of charge transferred decreases with increasing voltage. Furthermore, the enhancement to the hard discharge process which is achieved through higher voltage operation can lead to a reduction in the amount of pulse energy required to produce a desired level of performance for ignition applications. This in turn leads to a reduction in the total charge transfer per pulse, thereby providing an additional potential decrease in electrode wear.

Once the reaction has begun, according to the present invention, a major portion of the fuel charge will be rapidly consumed through the initiation of a combustion event consisting of a combination of rapid turbulent deflagration and/or supersonic detonation processes. The result is an effective combustion reaction velocity which is greater than normal burn velocities. Additionally, the transport phenomena of conventional burn reactions are primarily thermal gradient-driven molecular kinetics, whereas the HDI energy transport mechanisms also include intense radiation and high speed shock wave pressure discontinuities which provide the elements necessary for SWASER and SWASER type synergy. Accordingly, the HDI method of the present invention provides highly probable and robust ignition, extends the lean ignition and combustion limits beyond the capabilities of conventional thermal ignition systems, and promotes higher otto-cycle engine efficiency by initiating a more rapid overall combustion event.

Figures 12A, 12B:
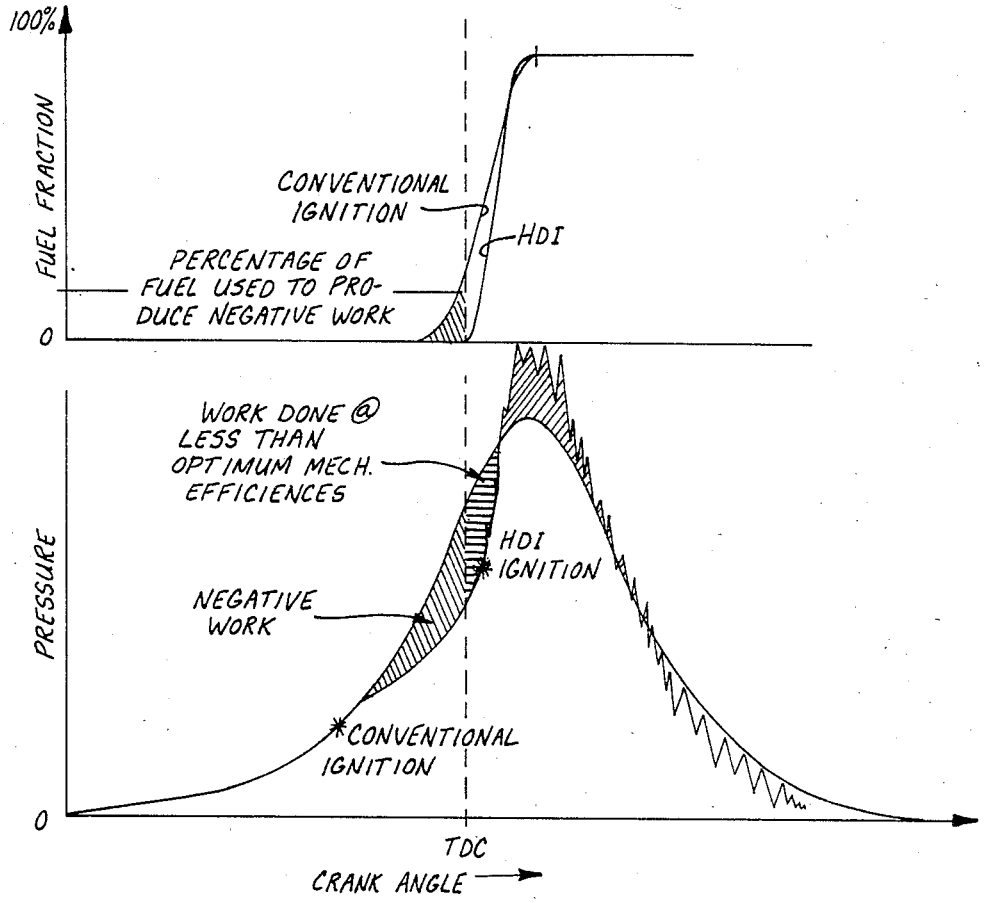
FIGS. 12A and 12B depict plots, respectively, of the fuel fraction and pressure versus crank-angle with conventional ignition systems and the HDI system of the present invention.

The advantages of HDI operation can be seen in FIGS. 12A and 12B which compare HDI operation with conventional ignition systems. As shown in FIG. 12B, it is necessary to initiate ignition in a conventional system prior to a piston reaching top dead center because the combustion produced by the conventional ignition is relatively slow. This advanced timing requirement results in a portion of the combustion occurring prior to top dead center, thus effectively converting a portion of the combustion energy into negative work. The relative percentage of fuel which is burned to produce this negative work is shown in FIG. 12A. In contrast, HDI provides efficient engine operation with considerably reduced timing advance, and possibly with ignition at or slightly after TDC, thereby reducing and possibly eliminating expenditure of fuel energy for negative work. It can be seen in FIG. 12A that a substantially greater fraction of the available fuel is combusted within a substantially shorter time interval, in terms of crank angle, compared to conventional ignition systems. Moreover, as shown in FIG. 12B, a substantial portion of the positive work resulting from conventional ignition combustion is performed at a substantially lower pressure than the work performed by HDI operation; the higher peak pressures attained by HDI operation are a result of the combustion occurring at a relatively constant volume with minimal heat losses.

The description thus far has been limited to the closely-coupled, low inductance, capacitive-discharge circuit for producing HDI operation. In order to achieve HDI operation with the closely-coupled, low inductance, capacitive-discharge circuit, it is necessary to pulse-charge the discharge circuit to a sufficiently high voltage to cause breakdown of the ignitor tip gap. The description will now turn to the details of a typical pulse generation and distribution system for pulse-charging the discharge circuit.

Operating System

Figure 13:
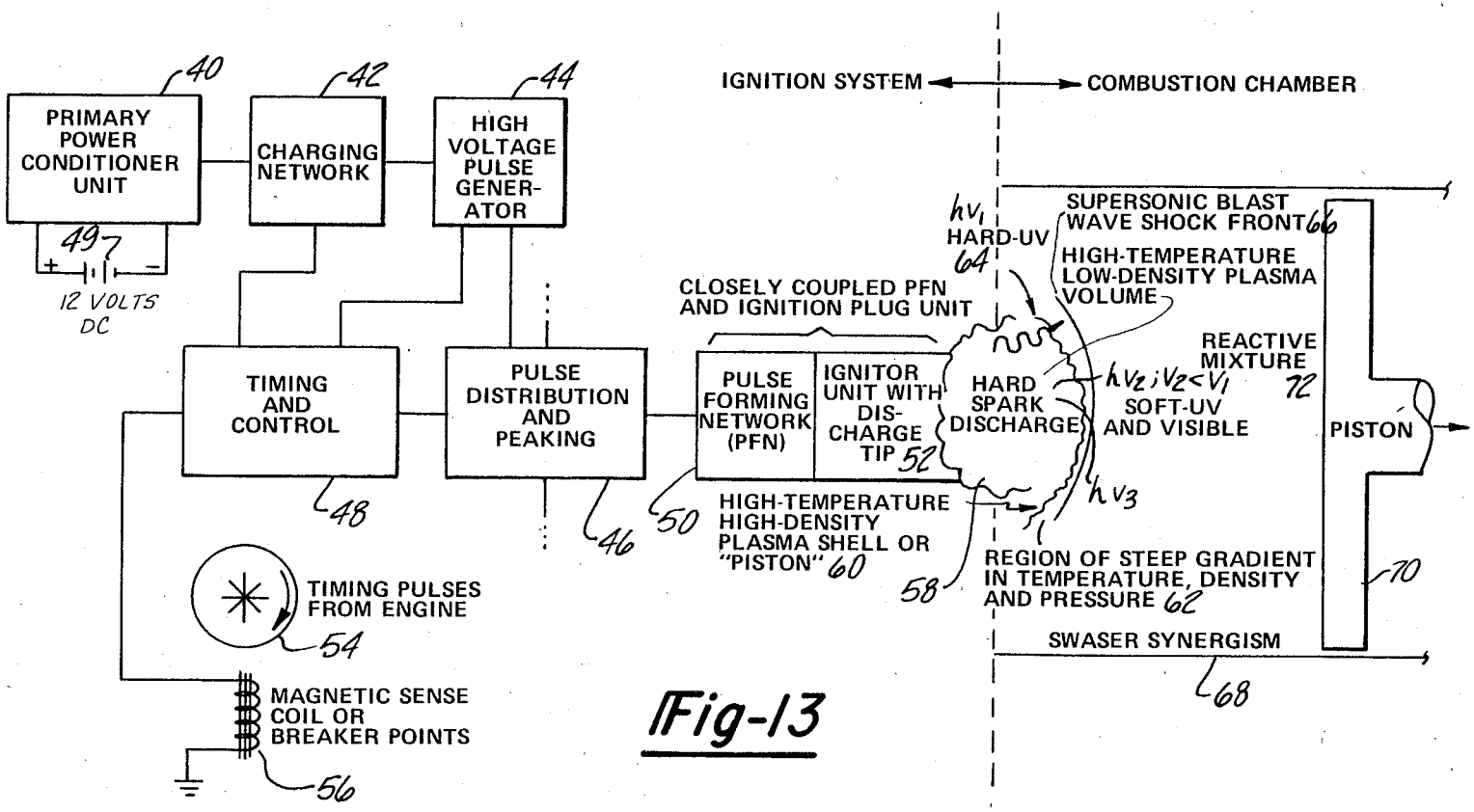
FIG. 13 is a combined broad block diagram and diagrammatic view of the combustion initiation system employing hard discharge which forms the preferred embodiment of the present invention.

Reference is now made to FIG. 13 which depicts the broad functional components or sub-systems of the pulse generation and distribution circuit of the present invention. A source of 12 volt dc, such as a conventional automobile battery 50 provides dc power to a primary power conditioning unit 40. Power conditioning unit 40 consists of a dc to dc convertor arrangement which may consist of an essentially free-running, resonant, multi-vibrating 12 volt to between 200 and 6,000 volt regulated supply. 200 to 6,000 volts dc is supplied by the power conditioning unit 40 to a charging network 42 which includes a later discussed flywheel capacitor which stores enough energy to supply a plurality of high voltage pulses. A high-voltage pulse generator 44 produces high voltage pulses using the charge supplied by charging network 42 and delivers these high voltage pulses to a pulse distributing and peaking circuit 46. The charging network 42, pulse generator 44 and pulse generation and peaking circuit 46 are controlled by a timing and control circuit 48 which receives a train of timing signals from an appropriate source, such as a magnetic sensing coil or breaker points 56 which sense the rotation of some portion of the engine, such as the crankshaft camshaft 54.

High voltage pulses are delivered to a pulse forming network (PFN) which is closely coupled with a later discussed ignitor unit 52. Ignitor unit 52 includes a discharge tip communicating with a charge of reactive fuel mixture 72 within a closed combustion chamber 68 having a piston 70 connected with the crankshaft 54. The ignitor unit 52 in combination with the PFN 50 produces the previously discussed hard spark discharge 58 within the combustion chamber 68. The hard spark discharge 58 comprises an ignition kernel from which there radiates a supersonic blast wave front 66 followed by a high temperature, high density plasma shell or "piston" 60. The region 62 from the piston 60 and extending beyond the blast wave front 66 consists of a steep gradient in temperature, density and pressure. Hard ultraviolet radiation 64 also radiates from the discharge 58, and cooperates with the blast wave shock-front 66 and plasma piston 60 to initiate combustion in the reactive mixture 72 in a very rapid manner according to the synergistic SWASER phenomena.

A conventional capacitive discharge or induction system may be employed to pulse charge the PFN 50 and ignitor unit 52, however, such conventional systems are limited in the amount of capacitive loading which can be achieved while maintaining a relatively high output voltage. Such systems are typically limited to secondary circuit capacitance of about 100 pf or less with output voltages in the range of 20 to 30 kv. Consequently, these systems are capable of delivering maximum pulse energies of approximately 50 mJ or less to the PFN 50 and ignitor unit 52; these energy levels offer some degree of enhanced ignition performance, however we have found that in order to achieve significantly enhanced combustion with relatively high efficiency, it is necessary to deposit energy in the reactive mixture 72 amounting to several hundred mJ/cm of discharge gap length. Experiments have demonstrated that combustion enhancement increases significantly as the deposited energy increases from about 60 mJ per pulse to several Joules per pulse. In general, the range of combustion enhancement will depend upon the operating characteristics of the engine and the discharge power level.

In the case of a conventional eight-cylinder internal combustion engine, approximately 400 ignition pulses per second must be generated at 6,000 rpm. At this speed time interval between pulses would be approximately 2.5 ms. Assuming an overall ignition system operating efficiency of 50% and an available discharge pulse energy of 1 Joule, approximately 800 watts of power are required from the engine's electrical system to achieve energy deposition of 1 Joule per pulse. Normally, the maximum allowable power drain on a typical 12 volt dc automobile system is approximately 600 watts. Thus, it may be seen that for existing automobile electrical system, an upper practical limit for the deposited ignition system pulse energy is dictated by the overall ignition system efficiency and the expected maximum pulse repetition rate. A practical upper limit for typical existing automotive systems is probably somewhat less than 1 joule per pulse of delivered discharge energy. However, it has been found that the improvement in engine power for a given level of fuel consumption can be increased to a point which justifies the use of a higher capacity primary electrical system capable of supporting the higher power drain of the ignition system at deposition energies of 1 Joule or more.

Ignitor Tip Geometry

Attention is now directed to FIG. 14 wherein various forms of a discharge tip for use with the ignitor 52 are depicted. Certain constraints must be placed on the gap between the electrodes at the discharge in order to achieve HDI operation. The predominant factors affecting HDI operation are the value of the inductance of the overall ignitor unit and a gap length sufficient to hold off the voltage level applied to the electrodes. These criteria may be satisfied by numerous discharge tip and gap geometries, providing that inductance and impedance are maintained below a prescribed value. However, it is desirable to provide a geometry and configuration which maximizes the efficiency with which the available circuit energy is coupled into the discharge, and from the discharge to the combustible mixture via light, heat, shock and ion production. Discharge tip geometry also affects longevity of the ignitor in terms of insulator and conductor wear due to the presence of extremely hot plasma and strong shock wave production.

Figure 14A:
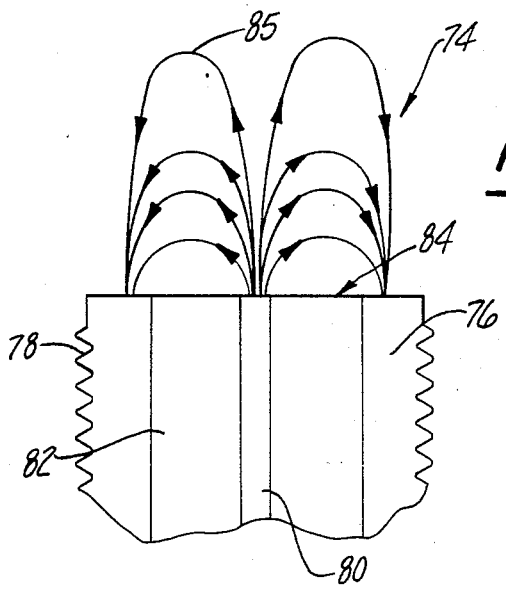
FIG. 14A is a fragmentary, cross-sectional view of a firing tip geometry which forms a portion of a hard discharge system of the present invention.
Figure 14B:
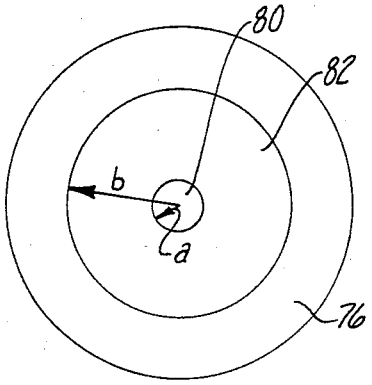
FIG. 14B is an end view of the firing tip shown in FIG. 14A.

Discussed hereinbelow are two preferred forms of discharge tip design which are highly suitable for achieving HDI operation. One of the tip designs is depicted in FIGS. 14A and 14B and consists of inner and outer coaxial electrodes 80, 76 which are electrically insulated from each other by a cylindrically shaped insulator 82. The outer cylindrical wall of the outer electrode 76 is provided with a thread form 78 which is adapted to be matingly received in an engine block or the like in order to mount the ignitor so that a discharge tip communicates with the combustion chamber. The outer ends of electrodes 76 and 80, as well as the insulator 82, extend along a common plane or flat surface 84. The discharge gap formed by ignitor tip 74 is radial and extends circumferentially around the entire surface 84. Consequently, the electrical field indicated at 85 commences at the outer end of electrode 80 and possesses a radially outward trajectory to all points on the outer electrode 76 along its upper surface 84.

The ignitor tip 74 possesses minimum inductance and impedance because of the coaxial geometry of electrodes 76, 80 and the radial nature of the gap. The physical gap length of ignitor tip 74 is given by the difference in conductor radaii b-a shown in FIG. 14B. The gap length will be selected in accordance with the voltage-pressure conditions of the particular application and anticipated operating conditions. The wall thickness and nature of the insulator 82 must be selected so as to assure that breakdown between the electrodes 76, 80 does not occur along their lengths. It should be noted that for a coaxial geometry both the inductance and impedance are determined in large part by the natural logarithm of the ratio of conductor radii b/a and that the inductance and impedance may be minimized provided the difference in conductor radii, b-a equals the required thickness of the insulator 82 for internal voltage hold-off.

The electric field created by the voltage applied to electrode 76, 80 is shown at 85, with arrows indicating the direction that a positive test charge would move in the field (from positive to negative polarity). The field 85 is non-uniform, moving outwardly away from the surface 84, and it is believed that this non-uniformity in addition to the curvature of the lines of the field enhance the resulting discharge. The sharply curving nature of the field 85 changes the characteristic breakdown potential of the gap, accelerates charges moving in the field and tends to push the arc channel outwardly away from the tip due to magnetic forces, particularly where large current densities exist in the discharge. Moreover, the linear flow of current through the central or inner conductor 80 produces a magnetic field which interacts with the fields produced by the discharge to further enhance the discharge.

The flat, radial design of ignitor tip 74 tends to produce a discharge which has spatial symmetry and uniformity which maximizes the volume of fuel mixture which is contacted by the discharge. The smooth, unobstructed surface 84 precludes any detrimental effects due to flow conditions within the combustion chamber and exposes larger electrode surface for participation in the discharge, which has a tendency to prolong the life of the electrodes.

Figure 14C:
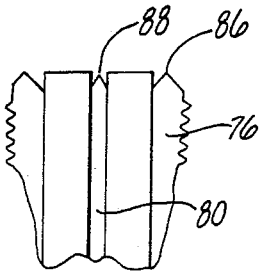

The ignitor tip 74 may be modified in various ways to further enhance its operation. For example, as shown in FIG. 14C, either or both of the outer ends of the electrodes 76, 80 might be pointed, as at 86, 88 in order to further "peak" the field 85. In other words, the field would tend to emanate from the peaks of the pointed tips 86, 88.

Figure 14D:
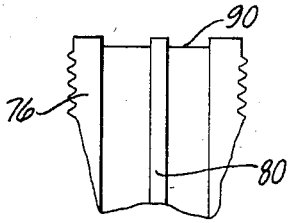

In order to avoid possible trenching of the insulator 82 at the surface 84, the outer edge of the insulator 82 may be slightly recessed at 90 as shown in FIG. 14D.

Figure 14E:
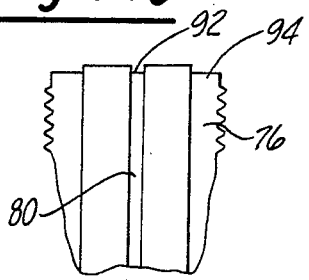

As shown in FIG. 14E, the discharge gap could be lengthened without increasing wall thickness by extending the insulator 82 outwardly beyond the outer surfaces of electrodes 76, 80; this design would be particularly effective in low pressure combustion environments or where higher breakdown voltage is required.

Figure 14F:
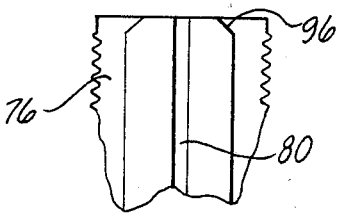

Conversely, as shown in FIG. 14F, the outer ground electrode 76 might be offset at 96 without compromising the internal hold-off voltage in those cases where lower voltage or higher compression operation is desired.

An alternative approach for lengthening the discharge gap consists of recessing the center electrode 80 from the end of the insulator 82 and outer electrode 76, as shown in FIG. 14G. A pronounced "jet" action due to the resultant cavity above the center electrode 80 has been noted with ignitors of this type. This jet is not likely due to an expulsion of plasma from the cavity, but rather is caused by reflected shock waves initially trapped during the channel expansion and/or possibly a stream of heavy ion species originally moving along electric field lines but at a later time following trajectories dictated by their inertia once the field has diminished.

To avoid excessive wear on the insulator 82, such insulator could be contoured at 83 as shown in FIG. 14H to present a tapered surface extending from the end of center electrode 80 radially outward to the outer electrode 76. The geometry shown in FIG. 14H provides the advantage of a recessed design which reduces insulator wear, but retains the jet or cannon line discharge effect.

Extension of the center electrode 80 beyond the end of the outer electrode 76 as shown in FIG. 14I also provides a means of increasing the discharge gap length. The tapered outer surface 85 of the insulator 82 again reduces wear on the insulator. Such an extension of the center electrode 80 into the combustion chamber assists in coupling and transferring the discharge energy to a fuel charge since the arc channel is well exposed to the fuel charge and is relatively unconfined.

As previously mentioned hereinabove, various ignitor tip and discharge gap configurations may be successfully employed to achieve HDI operation and in come cases it may be desirable to employ a linear or longitudinally extending tip gap. One suitable tip design employing a linear gap is shown in FIG. 14J The ignitor shown in FIG. 14J is broadly similar to conventional spark plug designs, with the outer electrode 76 having an L shaped extension 76*a* which provides an electrode surface axially aligned with the center electrode 80. Although the configuration shown in FIG. 14J may be employed with beneficial results in connection with the present invention, it is not the preferred form of ignitor geometry and in any event, it is necessary to minimize inductance and impendance in those components of the ignitor which are directly adjacent to the discharge gap while at the same time allowing sufficient gap length for breakdown at peak voltages.

In connection with the linear gap geometry, discharge occurs with virtually no wear upon the insulation due to arc while a desirable cylindrical shock wave is produced which is impeded only in the direction of the extended ground electrode. This exposure of the entire breakdown path lends itself to strong coupling and efficient energy exchange. Multiprong designs can be used in order to increase ignitor life inasmuch as there are additional surface areas between which a discharge can occur. It is important to orient these extra electrodes such that the discharge is not impeded in its growth nor shielded from the fuel charge thus prohibiting or quenching combustion promoting reactions.

Pulse Forming Network

As previously discussed with respect to FIG. 13, the pulse forming network 50 and ignitor unit 52 must be closely coupled. This close coupling results in a current flow discharge which is largely governed by the impedance of the discharge channel itself.

Figure 15:
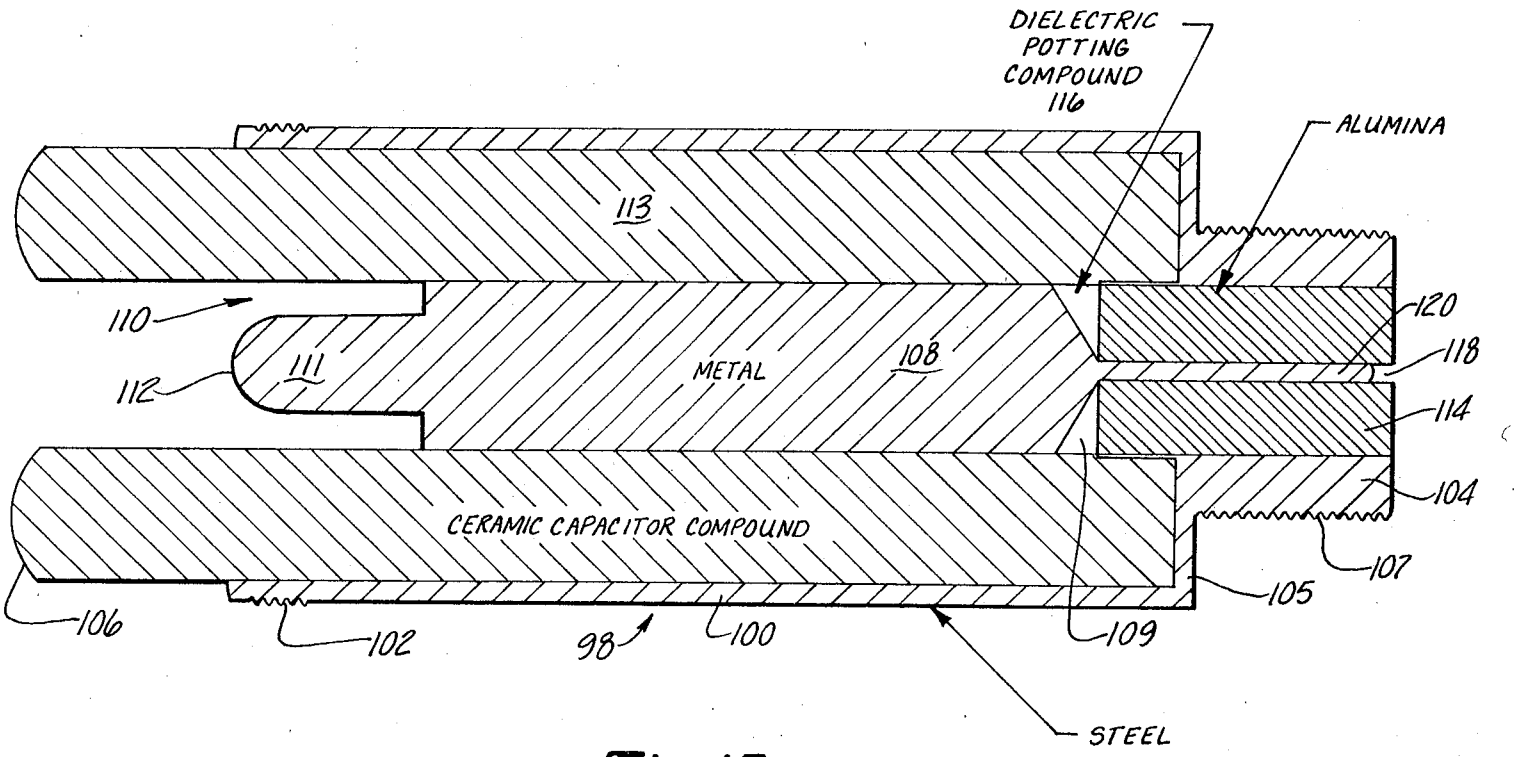
FIG. 15 is a longitudinal sectional view of an ignitor unit employing an integral discrete, lumped capacitance, pulse forming network.
Figure 16:
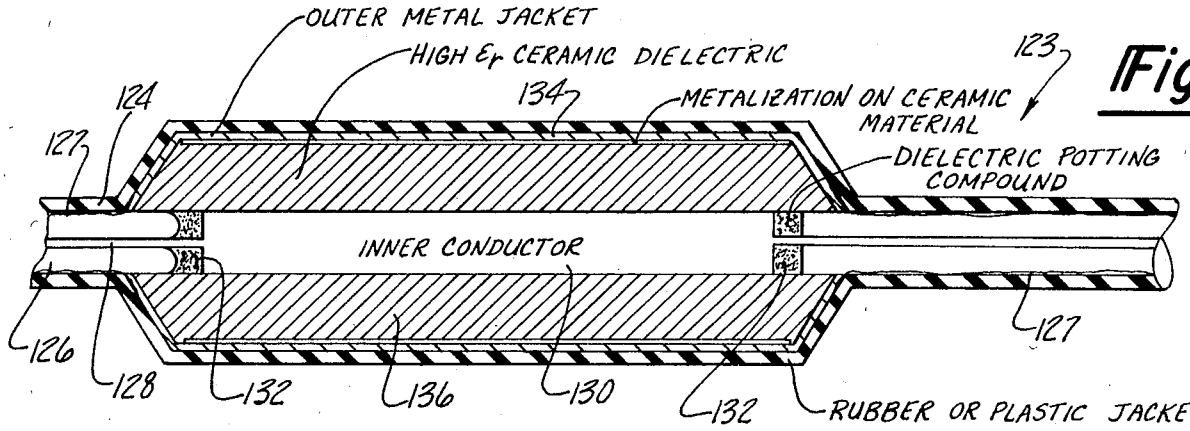
FIG. 16 is a longitudinal sectional view of a distribution cable employing another form of the pulse forming network having lumped capacitance.
Figure 17:
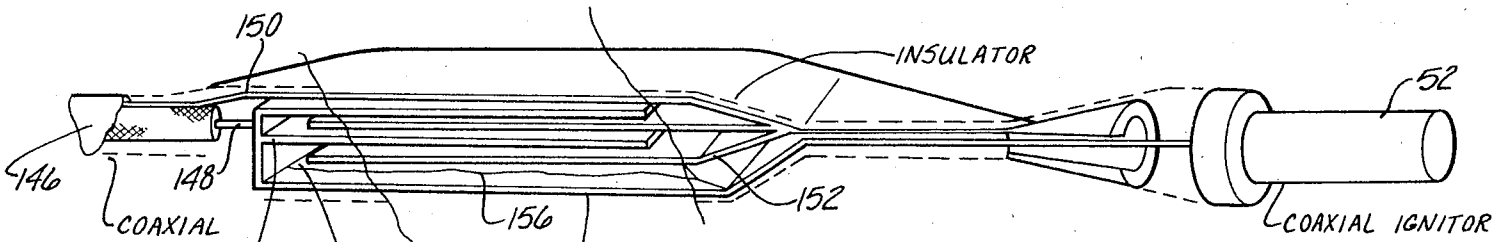
FIG. 17 is a perspective view, parts being broken away in section, of still another distribution cable having a pulse forming network employing lumped capacitance.
Figure 18A:
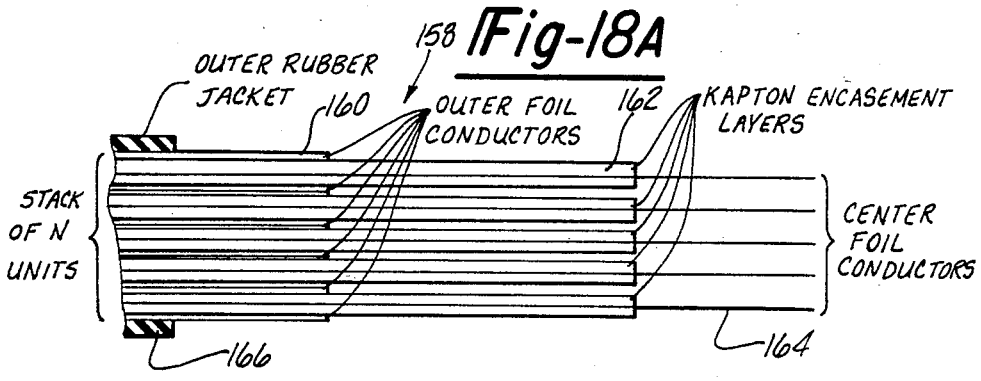
FIGS. 18A and 18B are longitudinal, sectional views of portions of distribution cables employing a pulse forming network having distributed capacitance.
Figure 18B:
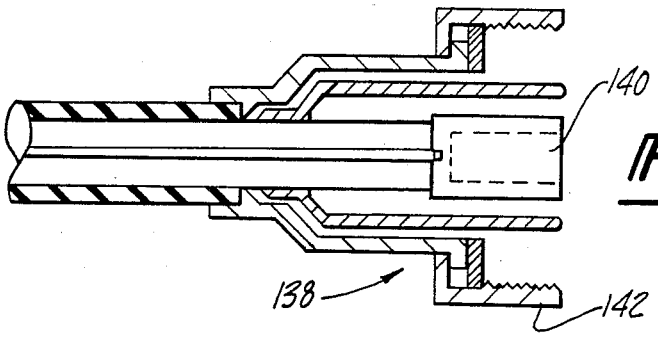

In order to achieve the desired close coupling, two types of pulse forming networks may be employed. The first will be termed herein as a distributed capacitance type and the second will be termed a "lumped" or discrete capacitor type pulse forming network. Discrete capacitor type PFN's are shown in FIGS. 15, 16 and 17. Distributed capacitance PFN's are shown in FIGS. 18A and 18B. The preferred PFN is shown in FIG. 15 which discloses a coaxially configured ignitor 98. The integral PFN-ignitor 98 achieves the lowest possible inductance and therefore provides maximum coupling to the discharge channel. Additionally, a later discussed capacitive portion of the ignitor 98 need not be designed to have an extended service life since it is removed and replaced periodically when the ignitor tip becomes worn and requires replacement.

The ignitor 98 includes a cylindrical outer electrode 100 formed of metal or the like and includes a reduced diameter portion 104 at one end thereof which is connected to the larger diameter portion by a radially extending shoulder 105. The smaller diameter portion 104 is threaded at 104 so as to be threadably received within an engine block or the like. The outer end of the larger diameter portion of the electrode 100 is threaded at 102 so as to threadably connect with a power supply distribution cable.

A central, metal electrode 108 is cylindrical in shape and is disposed coaxially within the outer electrode 100. One end of the central electrode 108 includes a reduced diameter extension 120 which is received within a passageway 118 and an insulating sleeve 114 which is secured within the reduced diameter portion 104 of the outer electrode 100. One end of the central electrode 108 is beveled around its entire circumference 109 and a suitable dielectric potting compound 116 is interposed between the end of the insulator 114 and the beveled surface 109 of the central conductor 108.

The outer end of the central electrode 108 is defined by a reduced diameter portion or tip 111 which terminates at its outer end in a hemispherical surface 112. The base of the central electrode 108 surrounding the tip 111 is defined by a ring-shaped, radially extending shoulder 110. The outer end of the outer electrode 100 extends longitudinally approximately the same length as the tip 111 of the central electrode 108.

A ring-shaped body 113 formed of a ceramic capacitor compound is disposed between the outer electrode 100 and central electrode 108. Body 113 extends the full length of the outer electrode 100 from the base or shoulder 105. The outer end 106 of body 113 extends beyond the outer longitudinal extremities of tip 111 or electrode 100. The central electrode 108, outer electrode 100 and capacitor compound 113 form the capacitive portion of the PFN.

Reference is now made to FIG. 16 wherein another form of a discrete capacitance PFN is disclosed. The PFN, generally indicated at 122 is formed in a coaxial cable 123 which connects a power supply (not shown) with a connector (not shown) which is adapted to be the cable 123 with an ignitor 52.

The PFN 122 comprises an inner conductor 130 surrounded by a sleeve 136 of high dielectric material, such as ceramic. A layer 134 of metalization on the outer surface of the dielectric sleeve 136 is connected with the outer conductor 127 and thus forms a continuous path for the flow of current through the cable 123. The inner conductor 130 is of substantially larger diameter than the central conductor 128 of cable 123 and is connected at its ends to the central conductor 128 as by welding or the like. A layer of dielectric potting compound 132 surrounds the connection between the central conductor 128 and inner connector 130. Inner conductor 130 in combination with the dielectric sleeve 136 and metalization 134 forms a capacitor which is in close proximity to the ignitor 52. The cable 123 includes a central conductor 128 electrically insulated from an outer cylindrical conductor 127 by means of suitable insulation 126. The cable 123 is covered with an outer sleeve of rubber or plastic 124.

The PFN 122 comprises an inner conductor 130 surrounded by a sleeve 136 of high dielectric material, such as ceramic. A layer 134 of metalization on the outer surface of the dielectric sleeve 136 is connected with the outer conductor 127 and thus forms a continuous path for the flow of current through the cable 123. The inner conductor 130 is of substantially larger diameter than the central conductor 128 of cable 123 and is connected at its ends to the central conductor 128 as by welding or the like. A layer of dielectric potting compound 132 surrounds the connection between the central conductor 128 and inner connector 130. Inner connector 130 in combination with the dielectric sleeve 136 and metalization 134 forms a capacitor which is in close proximity to the ignitor 52.

Although the PFN 122 provides a discharge circuit which is somewhat higher in impedance and inductance than that depicted in FIG. 15, it possesses the advantage of providing an ignitor which is relatively small and eliminates the problem of deliterious effects on the capacitor by additional heat to which it is subjected if positioned continguous to the combustion chamber.

Still another form of discrete capacitance PFN is depicted in FIG. 17. The PFN 144 is connected in series with the coaxial power supply cable 146 which connects the power supply (not shown) with the coaxial ignitor 52. The PFN 144 comprises first and second sets of flat plate capacitors 152, 154 which are interleafed and spaced apart using a dielectric material 156 to form a series of capacitor plates. Plates 152 are connected with the outer conductor of cable 146 while capacitor plates 154 are connected with the central conductor 148.

Figure 19:
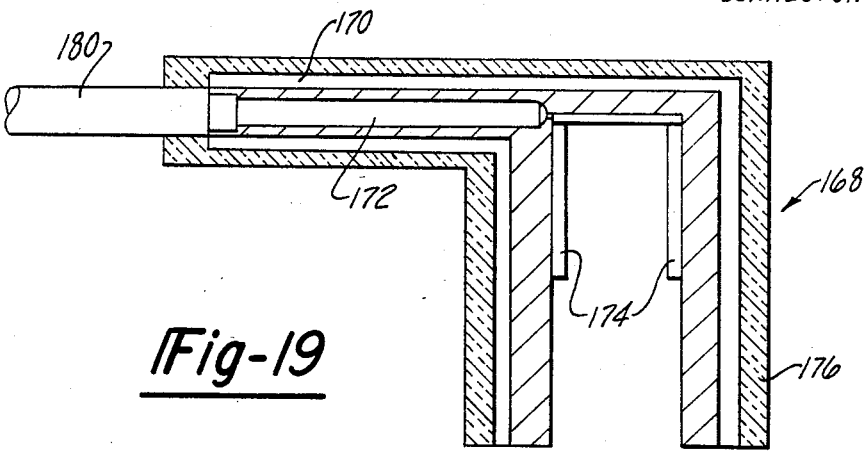
FIG. 19 is a cross-sectional view of a termination connector for use with the distribution cable shown in FIG. 18.

A distributed capacitance PFN 158 is depicted in FIG. 18A, which is formed integral with the distribution cable connecting the ignitor with the high voltage power supply. The cable including the PFN 158 is substantially flexible but yet does not possess a diameter too large to be used in existing automobile engines. The PFN 158 comprises a stripline geometry in which a plurality of flexible, outer foil conductors 160 are interleafed with a plurality of inner foil conductor 164 and are separated therefrom by a plurality of layers of dielectric material such as a polyamide film. The foil conductors 162, 164 may extend a substantial portion of the length of the entire cable and the sandwiched construction is enclosed by an outer rubber or plastic jacket 166. As shown in FIG. 19, the stripline configuration may be terminated in a connector 168 which is adapted to releasably connect the cable with an ignitor. The inner foil conductors 164 are terminated in a single connection which is secured to the center conductor 172 which in turn is connected with a metal contact 174 disposed within a cap 176 which fits over the electrical leads of the ignitor. The foil conductors 160 are terminated in a connection with lead lines 170 within the cap 176. Contacts 174 and lead lines 170 respectively interconnect with the electrodes of the ignitor.

Another form of distributed capacitance PFN is depicted in FIG. 18B. The PFN comprises the coaxial cable 123 which is connected to an ignitor (not shown) by a connector 138. The connector 138 includes an outer threaded coupling 142 which is threadably received by a portion of the ignitor, and an inner electrical connecting portion 140 which electrically connects the electrodes of the ignitor with the central conductor 128 and outer conductor 127 of the cable 123. The inner and outer conductors 127 and 128 form the distributed capacitance.

Primary Power Conditioning Unit

Figure 20:
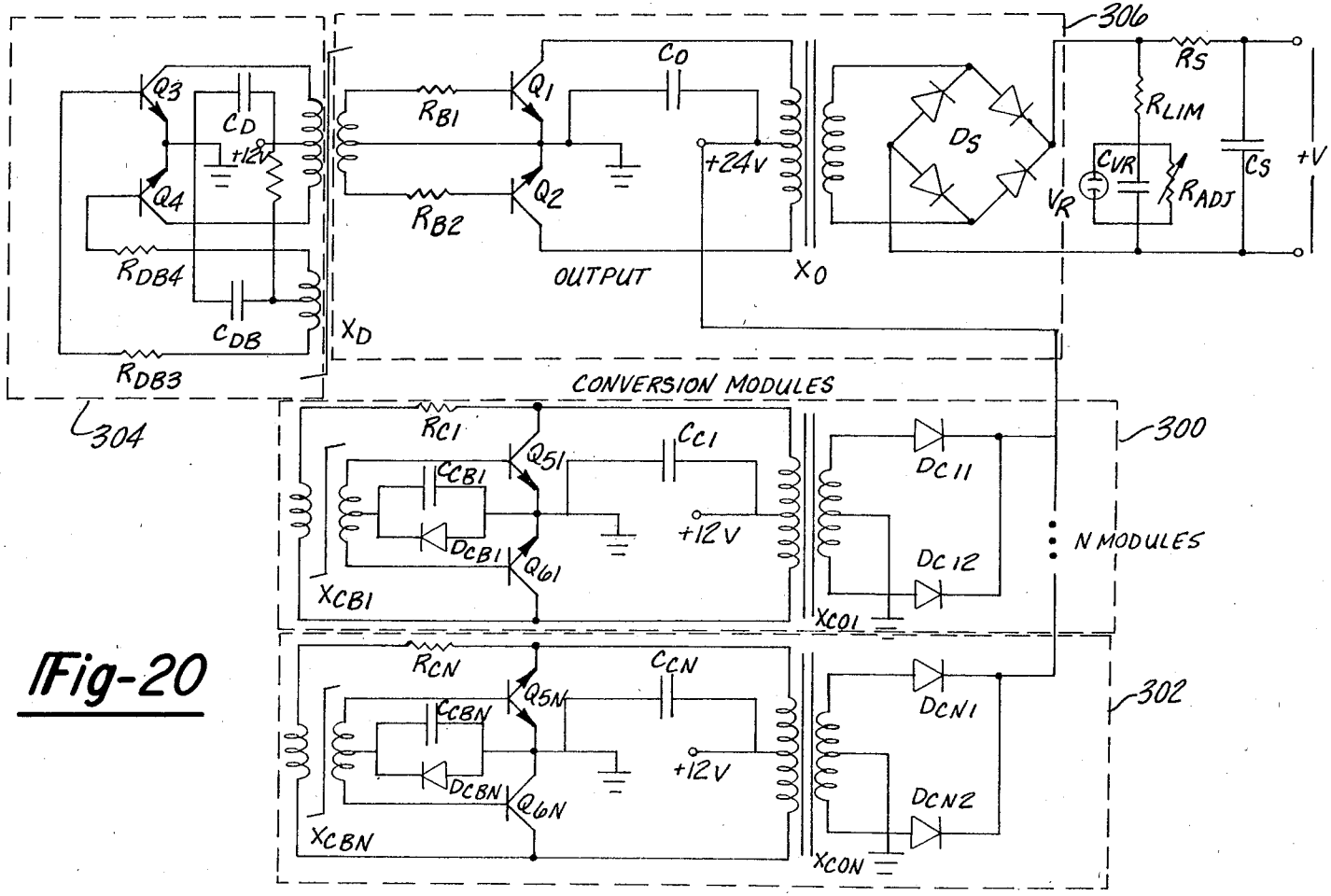
FIG. 20 is a detailed schematic diagram of a dc-dc power convertor for use in the combustion initiation system of the present invention.

Attention is now directed to FIG. 20 wherein the details of the primary power conditioning unit 40 are depicted. The conditioning unit 40 comprises a multistage dc-dc power convertor which consists of a plurality of voltage conversion modules 300,302, an output driver 304, and an output voltage oscillator 306.

The voltage conversion modules 300,302 receive a 12 volt dc input at terminals 310 from a battery and step up this voltage to 24 volts. The voltage conversion modules 300,302 effectively reduce the current requirements in the output stage by a factor of ½ and reduce the operating temperature of the convertor. Each voltage conversion module 300,302 essentially consists of a two-transformer, dc-dc convertor wherein the output transformer $X_{co}$ operates in a linear region at a frequency determined by a saturable transformer $X_{CB}$. The outputs of the voltage conversion modules 300,302 are rectified by diodes $DC_1$, $DC_2$ to provide 24 volts dc required by the output voltage oscillator 306. A plurality of the voltage conversion modules 300,302 may be connected in parallel relationship to increase the level of power delivered to the output voltage oscillator 306.

The output driver 304 drives the main output voltage oscillator 306. The output driver 304 is self-oscillatory due to the saturable transformer $X_D$ and provides the frequency and base drive current necessary to operate the output voltage oscillator 306.

The output voltage oscillator 306 provides an output voltage having sufficient power to allow continuous operation for all engine speeds. The intermediate voltage of 24 volts is transformed to a higher voltage, e.g. 400–500 volts, through a transformer $X_o$. The voltage output from the secondary of transformer $X_o$ is rectified to dc through a diode bridge $D_s$ and is thereafter stored in capacitor $C_s$ until required by the high voltage pulse generator 44 (FIG. 13).

A small amount of current is delivered through resistor $R_{lim}$ in order to drive a volt meter $C_{vr}$ which provides an indication of the available voltage.

It is to be understood that the converter described above is merely illustrative of various types of circuits which may be advantageously employed in connection with the present invention.

High Voltage Pulse Generator

The high voltage pulse generator 44 depicted in FIG. 13 will now be discussed in more detail, and in this regard reference is first made to FIG. 21.

Generation of the high voltage pulses for delivery to the ignitor unit 52 can be accomplished using inductive-coil techniques or capacitive-discharge techniques. The inductive-coil approach is well known in the art, is quite simple and requires relatively few components. However, because of the inherently slow rise times of the output voltage and the severe demands placed on the current-interrupt switch at higher energy levels, the preferred form of pulse generator employs transformed capacitor discharge.

Figure 21:
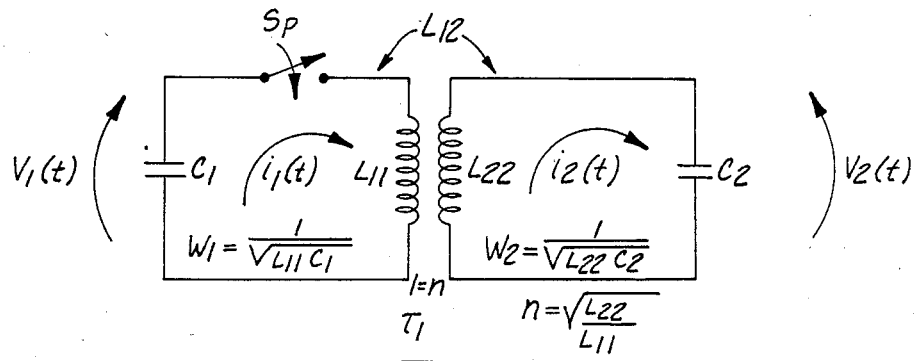
FIG. 21 is a schematic diagram of a transformed, capacitor-discharge high voltage pulse generator connected with a capacitive load.

FIG. 21 depicts a simple step-up transformer circuit in which energy originally stored in a primary capacitor $C_1$ at voltage $V_1$ is transferred through a step-up transformer $T_1$ to a capacitor $C_2$ at a higher voltage $V_2$. This method of high voltage pulse generation is particularly well adapted for use in the HDI system of the present invention because output load of the pulse generator is formed basically of the capacitance of the high voltage circuit of the pulse forming network 50 (FIG. 13). $L_{11}$ and $L_{22}$ are the self-inductances of the primary and secondary windings respectively of transformer $T_1$. Inductor $L_{12}$ is the mutual inductance between the primary and secondary windings. Thus, the circuit shown in FIG. 21 comprises two inductively coupled resonant circuits, each of which has a fundamental resonant frequency governed by the inductances and capacitances of each circuit. The general solution of these two coupled circuits consists of primary and secondary current flow, $i_1(t)$ and $i_2(t)$, each being defined by two superimposed sinusoidal functions of different frequency. The overall operation of this circuit consists of the cyclical transfer of energy from the primary to the secondary circuit and then back to the primary circuit. In general, an increase in coupling between the primary and secondary circuits increases the rate of energy transfer and decreases the overall period of energy cycling between the circuits.

When the primary and secondary circuits of FIG. 21 have the same fundamental resonant frequency and the coupling coefficient (k) is exactly equal to 0.6, the overall circuit operates in a dual-resonance transformation mode and is characterized by total energy transfer from the primary circuit to the secondary circuit during the duration required for two half cycles of current flow in both the primary and secondary circuits.

Figure 22A:
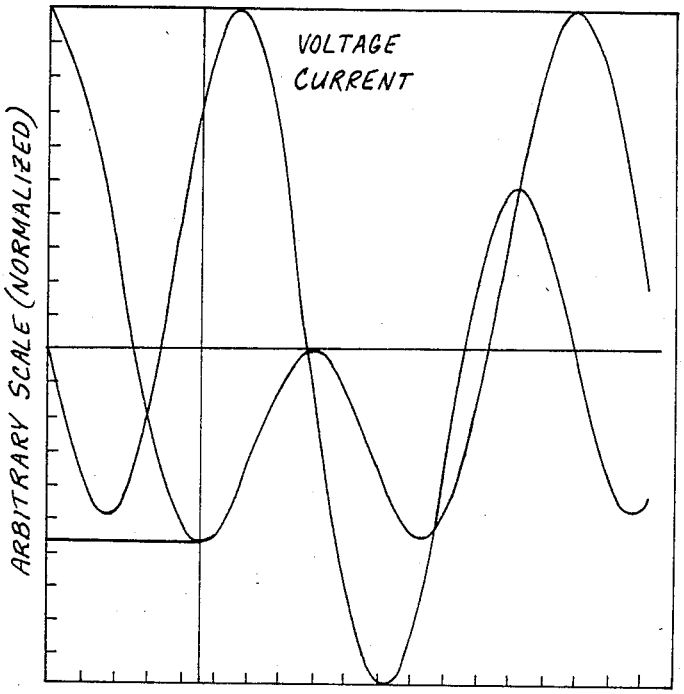
FIGS. 22A and 22B are graphs respectively depicting primary and secondary voltages and current flow for a dual-resonant transformer circuit employed in the combustion initiation system of the present system.
Figure 22B:
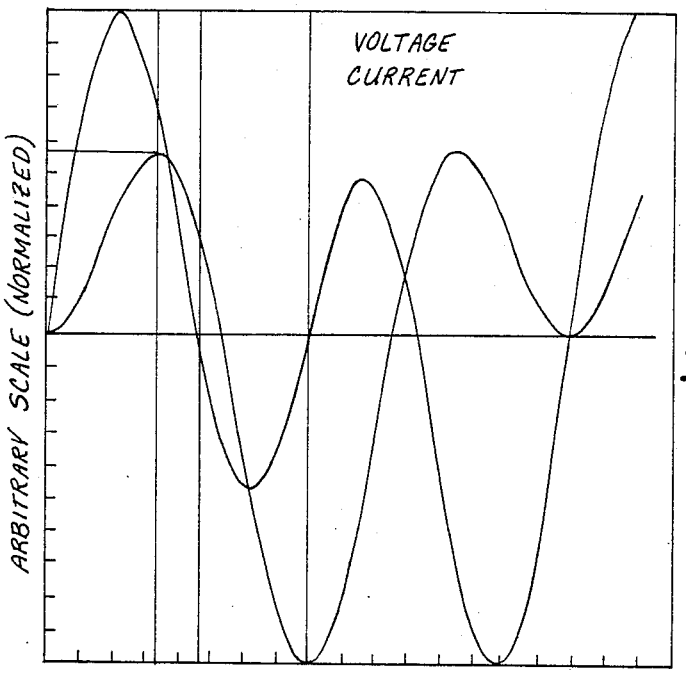

FIGS. 22A and 22B depict the current and voltage behavior in both the primary and secondary circuits shown in FIG. 21 as a function of time, for dual resonance operation. A notable feature of dual resonance operation is that the secondary voltage first reaches a peak having a magnitude which is 60% of the final peak output voltage. The voltage then undergoes a polarity reversal and attains the final output voltage peak, at which time the voltage and current in the primary circuit both become zero. This operation is unique to dual-resonance transformation where, at the time of peak secondary voltage and energy level, the energy in the primary circuit is exactly zero. Hence, theoretically, 100% energy transfer efficiency is possible. In practice, energy transfer efficiencies approaching 95% have been achieved with air-core transformers operating in the dual resonance mode.

Because of its potentially high energy transfer efficiency and its high power capacity, the present invention employs a high voltage pulse design based on the use of an air-core, spiral-strip dual resonance transformer. The air-core design eliminates loss and breakdown problems associated with magnetic core materials and allows for low loss, high efficiency operation at relatively high energy levels. Spiral-strip construction allows for relatively easy transformer design and assembly, and is less susceptible to transient voltage breakdown problems.

In order to successfully employ dual-resonance transformation, which requires current and voltage reversal in both the primary and secondary circuits, it is necessary to employ a switch $S_p$ which allows current flow in both directions. The extraction of energy from the secondary circuit must be timed to occur near the attainment of peak output voltage at the crest of the second half-cycle of voltage on capacitor $C_2$. In the absence of a hold-off device such as a saturable inductor diode or a gas breakdown switch designed to turn on at the desired output voltage, this requires that the ignitor spark gap be preferably sized to breakdown within a specified voltage range for given conditions of temperature and pressure. Premature breakdown due to loss of compression or a significant advance in engine timing would reduce the available energy stored in the hard discharge circuit at the moment of breakdown and would lead to additional electrode wear due to continued delivery of current during the later arc phase of the discharge.

As will be discussed in more detail later, this problem can be substantially reduced or eliminated by employing a pulse compressing hold-off device such as a saturable inductor or gas switch, between the output capacitor $C_2$ and the discharge pulse forming network. This approach also provides the advantage of a faster-rising output voltage pulse which can potentially "overvolt" the ignitor gap. Alternatively, the pulse generator can be designed to operate in an off-resonance mode (i.e., as a common pulse transformer) in order to deliver a fast-rising output pulse which reaches maximum voltage on the first half cycle. This latter mentioned mode of operation has a lower theoretical energy transformation efficiency but is nevertheless capable of transferring a reasonable fraction of the available energy in a relatively short time frame without the need for reversal of voltage and current. This approach would also eliminate the need for a bidirectional primary switch and reduces the dielectric stress on capacitors $C_1$ and $C_2$ caused by the voltage reversal.

When maximum energy transfer efficiency is of secondary importance, the pulse transformer mode of operation can provide fast-rising output pulses with less overall complication in circuitry, however it is necessary to achieve a transformer coupling coefficient which approaches unity to provide rapid first half cycle energy transfer. For purposes of the present disclosure, it is understood that the high voltage pulse generator discussed herein may operate in either the dual resonant mode or the off-resonant pulse transformer mode discussed hereinabove.

Figure 23:
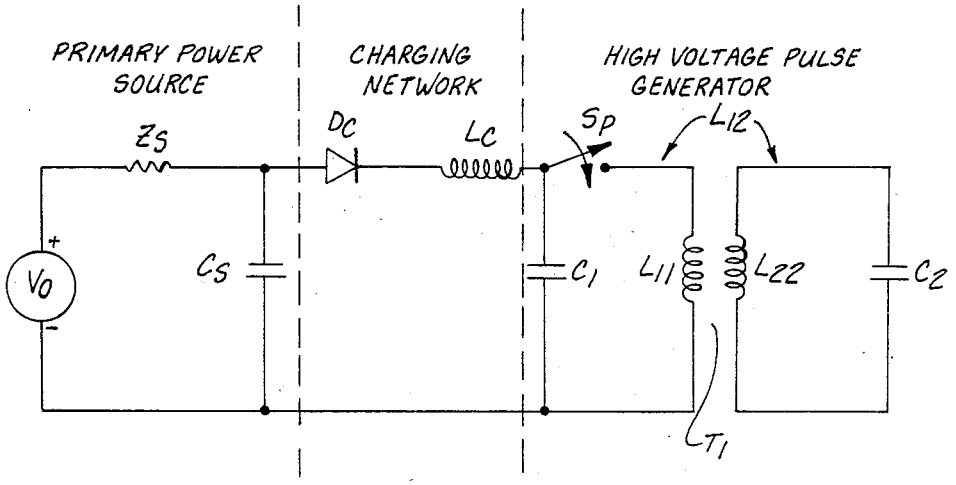
FIG. 23 is a view similar to FIG. 21 but further showing the primary power source and charging network.

Prior to generating a high voltage pulse by closing switch $S_p$ in the circuit shown in FIG. 21 the primary capacitor $C_1$ is charged to a prescribed voltage by the previously discussed primary power source 40 via the charging network 42 shown in FIG. 23. The primary power source of voltage $V_o$ and impedance $Z_s$ charges a relatively large storage capacitor $C_s$. Capacitor $C_s$ is sufficiently large to store the equivalent of a plurality of pulses, thereby acting as a system buffer or "flywheel" which smoothes out the energy demands on the previously discussed power supply. Although the primary power supply might consist simply of a 12 volt dc battery/alternator/regulator system of a conventional automobile electrical system, it is desirable and considerably more efficient to employ a power conditioning stage which converts the 12 volt dc power supply to a higher voltage, typically on the order of several hundred to several thousand volts as previously discussed. In this manner, considerably less voltage step-up is required in the pulse generator, lower magnitudes of current are required to transfer a given quantity of energy and the given quantity of energy can be stored in less physical volume due to the higher energy densities possible at higher voltages.

The inductive charging network 42 shown in FIG. 23 comprises a diode $D_c$ connected in series with an inductor $L_c$ and provides a low-loss transfer of energy from capacitor $C_s$ to capacitor $C_1$ and can also yield a voltage gain by nearly a factor of 2.

Figure 24:
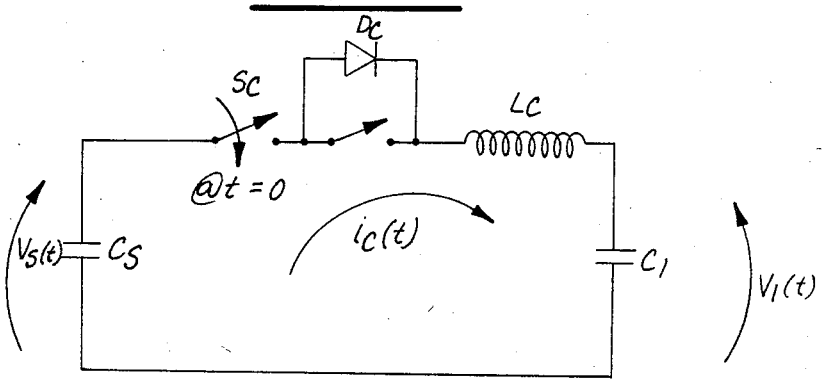
FIG. 24 is a schematic diagram of an inductively coupled dc charging circuit.
Figure 25:
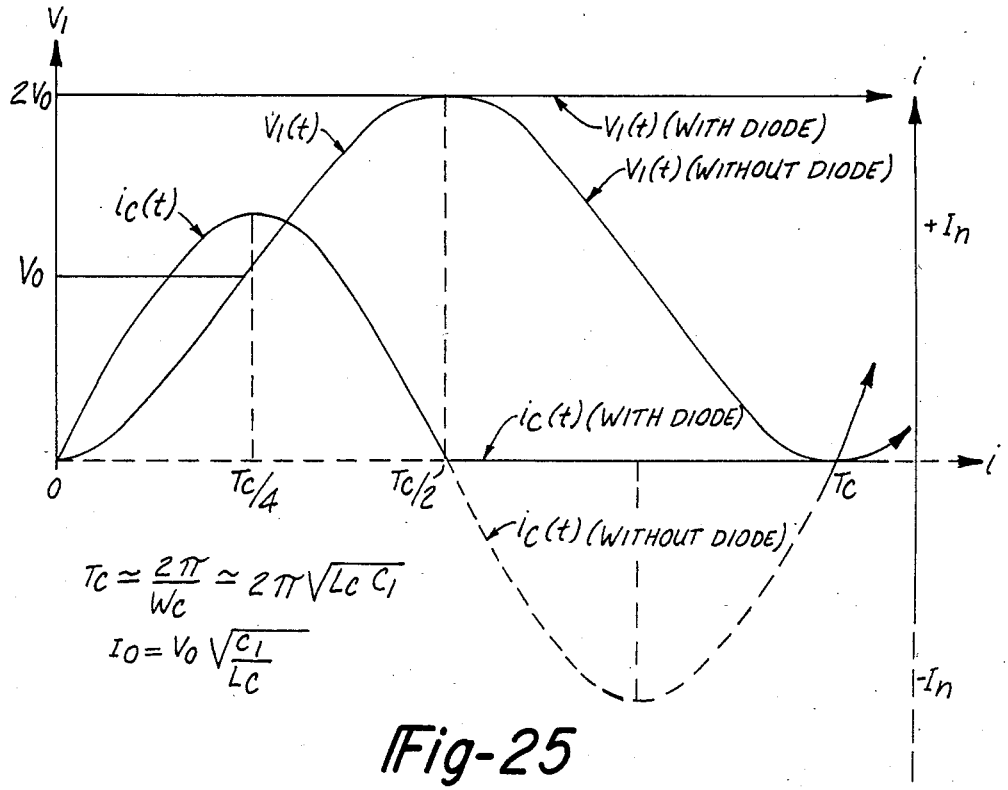
FIG. 25 is a graph of the current and voltage for the circuit of FIG. 24.

The operation of dc inductive charging is best understood by reference to FIGS. 24 and 25 which depict an idealized case with no resistive losses. As is apparent from FIG. 25, the use of the blocking diode $D_c$ prevents the energy in capacitor $C_1$ from ringing back into the capacitor $C_s$, thereby holding the charge voltage on $C_1$.

The charging network 42 also provides electrical isolation of the primary circuit of the pulse generation circuit from the electrical power source 40 and energy storage capacitor $C_s$; this is achieved by choosing a value for inductor $L_c$ sufficiently large to make the charging circuit time constant $T_c$ much larger than the discharge constant of the pulse generation circuit. In practice, $T_c$ will typically be on the order of several hundreds of microseconds to a few milliseconds, while the discharge time constant of the pulse generator will usually be no more than a few tens of microseconds.

In order to achieve reliable operation and isolation, it is important that the pulse not be initiated by closing the switch $S_p$ (FIG. 23) prior to the completion of the charging of capacitor $C_1$. For this reason, the minimum time interval between impulses should always be longer than the time required for the charging network current flow to terminate. From FIG. 25 it is apparent that this minimum time interval is $T_c/2$.

Figure 26:
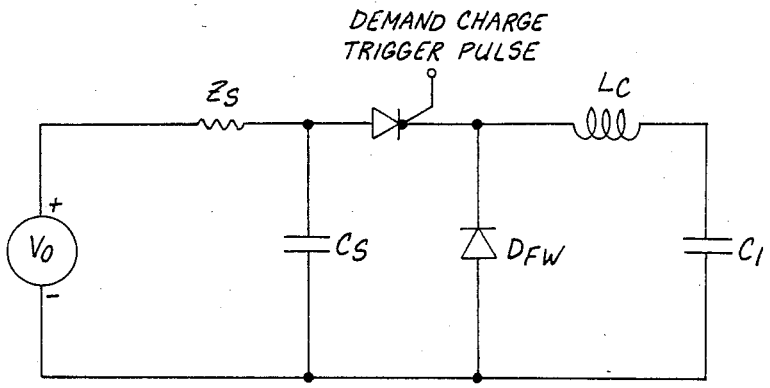
FIG. 26 is a schematic diagram of an inductive charging network employing demand charging.

An alternate form of the inductive charging network 42 is depicted in FIG. 26 in which an SCR is employed as a switch, rather than the diode $D_c$ previously discussed. It is contemplated that transistors and other gate control thyristor devices could also be employed. Although this alternate form of the charging network 42 require additional control circuitry to operate the SCR switch, it provides improved control of the charging process. Additional well-known techniques may also be employed which provide charge voltage regulation in order to maintain the operating voltage within desired limits.

Reference is now made to FIG. 27 which depicts the details of one embodiment of the present invention wherein the inductively charged high voltage pulse generator is employed in combination with a conventional mechanical distributor 182 of an automobile ignition system. The 12 volt dc power supply 50 and dc to dc convertor 40 charge the flywheel storage capacitor $C_s$, and pulses of energy are drawn from the flywheel capacitor $C_s$ through the previously discussed charging network 42 to a storage capacitor $C_1$. High voltage pulses generated by the pulse generator 44 are delivered through the coupling transformer $T_1$ to the pulse distribution and peaking circuit 46 in accordance with the opening and closing of primary switch $S_p$.

The secondary coil $L_{22}$ of the transformer $T_1$ is connected to the rotatable contact of distributor 182 through a later discussed optional pulse hold-off and peaking unit denoted by P. Alternatively, the optional hold-off and peaking unit P may be positioned in each distribution line between the distribution system and the discharge PFN unit. The high voltage pulses are delivered from the distributor 182 via a coaxial distribution line or cable 188 to the closely coupled pulse forming network 50 and ignitor unit 52. Timing signals are generated by the distributor 182 by means of a magnetic pickup 56 which produces a train of timing pulses that are squared up and amplified by a timing pulse conditioner 48*a* and are delivered to a trigger pulse generator 48*b*. The trigger pulse generator 48*b* uses the timing signals to control the operation of the primary switch $S_p$ through firing pulses delivered through line 186. Lines 184 provide the necessary power to the primary switch trigger generator 48*b*.

FIG. 28 depicts another alternate form of a circuit for the present invention which is generally similar to that depicted in FIG. 27 but further provides for demand-charge of the pulse generator 44 by means of an SCR in the charging network 42, in lieu of the diode $D_c$ in the circuit of FIG. 27. Timing pulses output from the timing pulse conditioner 48*a* are delivered to a time delay circuit 48*d* and a demand charge trigger generator 48*c*. The time delay circuit 48*d* is conventional in design and functions to delay the delivery of the timing pulses from the coil 56 to the trigger pulse generator 48*b* for a prescribed interval. The undelayed timing pulses delivered to the demand charge trigger generator 48*c* are employed to control triggering of the SCR in the charging network 42. The use of a time delayed trigger pulse from pulse generator 48*b* assures that capacitor $C_1$ has been fully charged following switching of the SCR, and the charging SCR has turned off, before switch $S_p$ is closed.

Switch $S_p$ may comprise any of various types of circuits, typical examples of which are depicted in FIGS. 29 through 36. In each of these circuits, the diode $D_r$ provides a path for reverse current flow. Although diode $D_r$ is required for dual resonant mode pulsing operation it may not be required in the off-resonance pulse transforming mode of operation.

Figure 29:
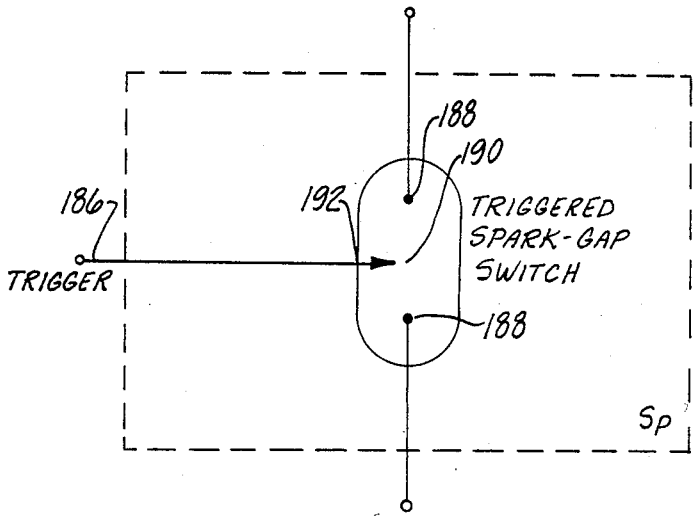
FIGS. 29–36 are detailed schematic diagrams showing alternate forms of the pulse generator primary switch unit.

As shown in FIG. 29, the primary switch $S_p$ may comprise a triggered spark-gap switch formed by a pair of spaced apart electrodes 188 defining a spark-gap 190. Voltage applied from the triggering input on line 186 (FIGS. 27, 28) is delivered to terminal 192 and results in the breakdown of the gap 190 and resultant current flow allowing discharge of capacitor $C_1$ into the transformer $T_1$.

Figure 30:
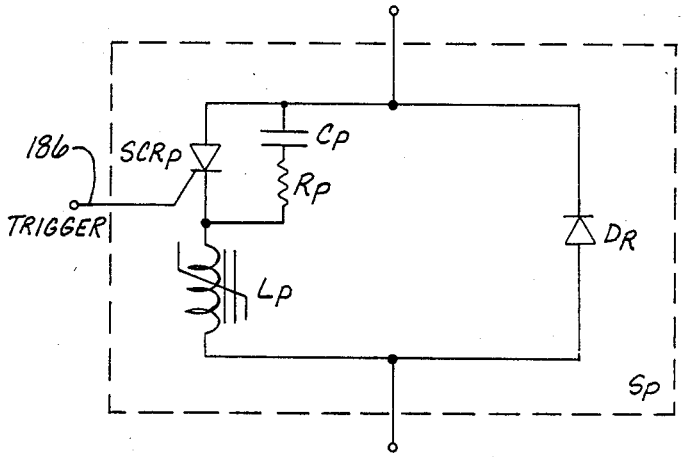

Another potential configuration for the switch $S_p$ is depicted in FIG. 30 wherein the trigger input is delivered to the gate of an SCR which is connected in a series circuit with a saturable inductor $L_p$ and a diode $D_r$. A series circuit consisting of a capacitor $C_p$ and resistor $R_p$ form an optional snubber network which is connected in parallel with the SCR. The saturable inductor $L_p$ functions to provide initial current hold-off until the SCR has fully turned on.

Figure 31:
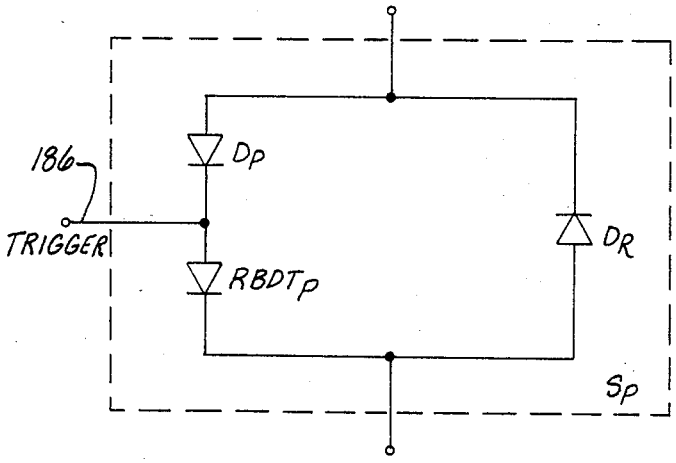

As shown in FIG. 31, the switch $S_p$ may comprise a diode $D_r$ connected in parallel relationship to a second diode $D_p$ and a single reverse blocking diode thyristor RBDT. In this circuit, the diode $D_p$ provides trigger pulse isolation.

Figure 32:
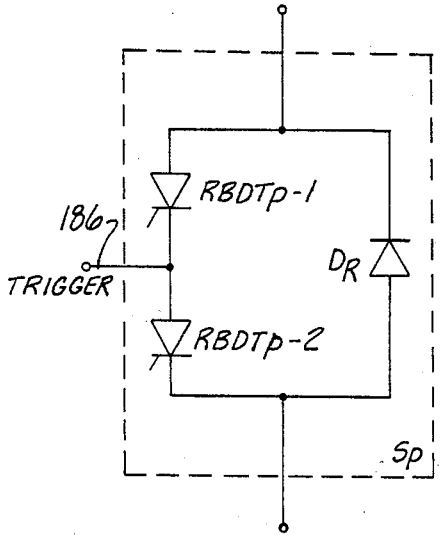

Another form of primary switch $S_p$ is depicted in FIG. 32 which is identical to that shown in FIG. 31 with the exception of that of the diode $D_p$ is replaced with a second reverse blocking diode thyristor to provide the necessary pulse isolation.

Figure 33:
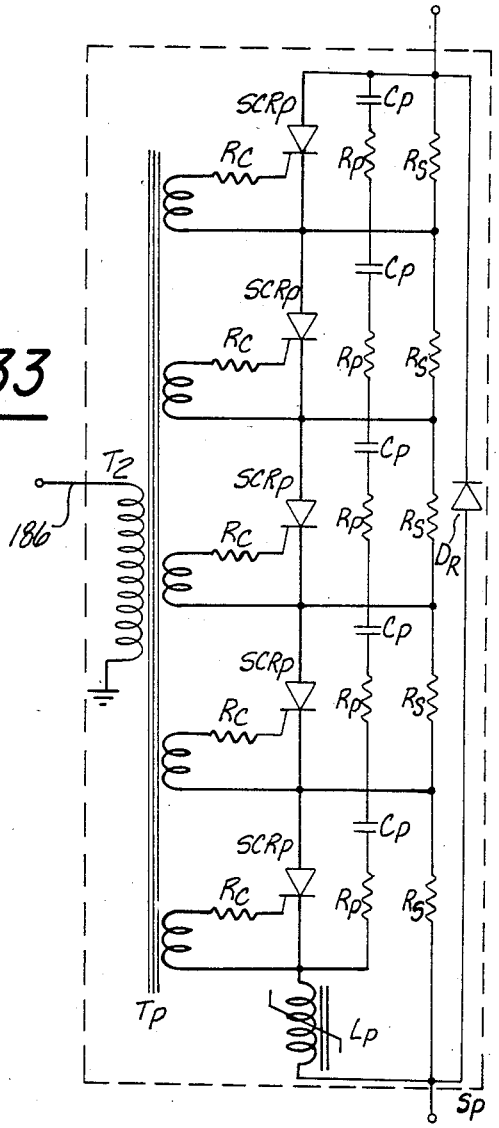

FIG. 33 depicts a primary switch $S_p$ consisting of a plurality of SCR's connected in series relationship and may be employed in those applications requiring especially high voltage pulses. Each of the SCR's includes an associated network of resistors and capacitors, $R_s$, $R_p$, and $C_p$ to provide static and dynamic voltage equalization. The trigger pulses derived from line 186 are coupled through a transformer $T_2$ to the trigger inputs of the SCR's.

Figure 34:
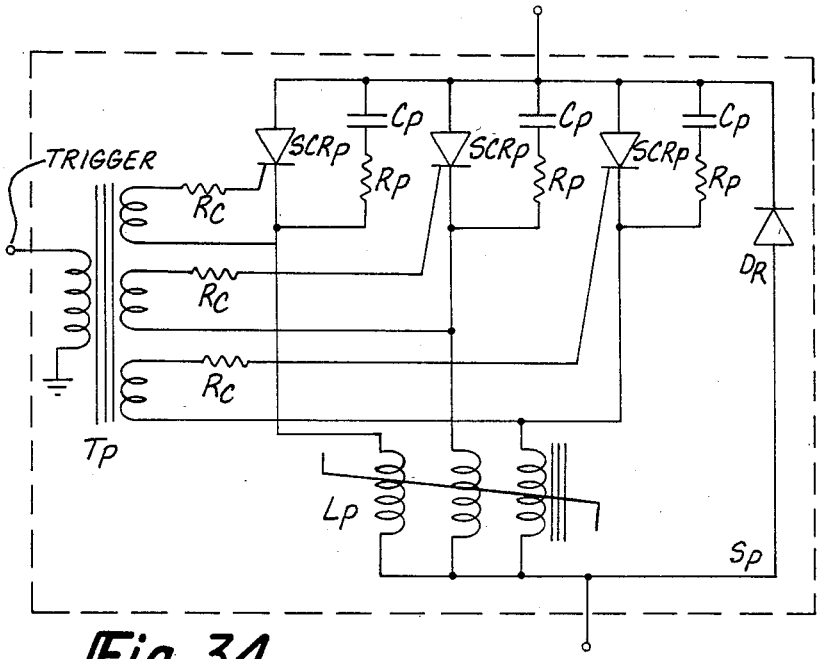

FIG. 34 depicts a primary switch $S_p$ in which a plurality of SCR's are connected in parallel relationship for increasing the current capacity of switch $S_p$. Capacitors $C_p$ and $R_p$ are employed as an optional snubber network and a multi-turn saturable inductor $L_p$ is employed to provide initial current hold-off to ensure that the SCR is turned on. The saturable inductor $L_p$ also provides current distribution among the parallel circuit branches associated with each SCR.

Figure 35:
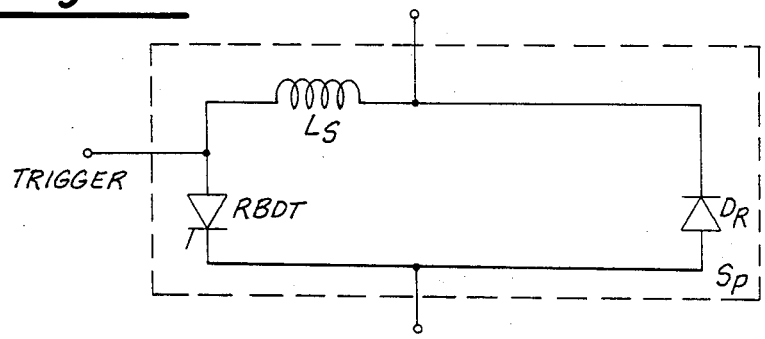

A relatively simple, and therefore economical circuit for the primary switch $S_p$ is depicted in FIG. 35 which consists of a single reverse blocking diode thyristor RBDT and an inductor $L_s$ connected in parallel relationship to a diode $D_r$. The inductor $L_s$ is employed here as a trigger pulse isolation device.

Figure 36:
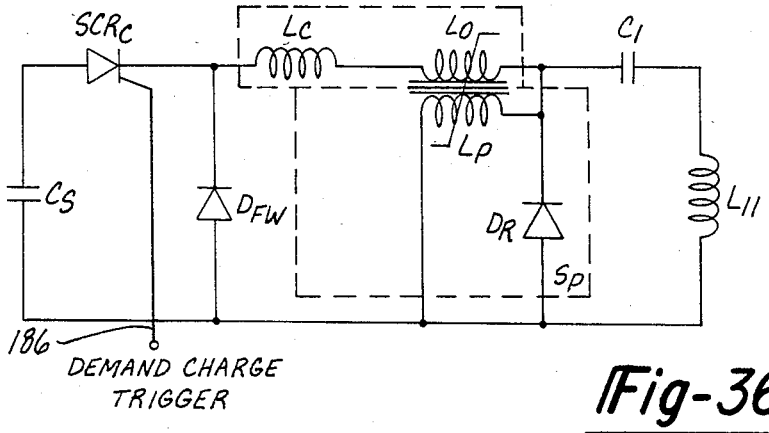

FIG. 36 depicts still another alternate form of the primary switch $S_p$. Current from the energy stored in flywheel capacitor $C_s$ is triggered through an SCR to the switch $S_p$ which comprises an inductor $L_c$, a saturable inductor including coils $L_b$ and $L_P$, and a diode $D_r$. A free wheeling diode $D_{FW}$ is employed to aid in turning off the SCR. The saturable inductor bias winding $L_b$ is employed as part of the charging inductance $L_c$. Initiation of charge current flow upon closing of the SCR causes resetting of the core of the saturable inductor. Upon completion of the charge cycle, the saturable inductor saturates and initiates the discharge of capacitor $C_1$.

Although a number of forms of the primary switch $S_p$ have been described above, the preferred forms are those employing a minimum number of components.

High Voltage Pulse Distribution and Compression

The energy transferred from the secondary $L_{22}$ of the pulse transformer $T_1$ (FIGS. 23, 27, 28) can be distributed to the ignitor units 52 either mechanically or electronically by means of a modified conventional distributor or by later discussed saturable inductor devices. In either case, a desirable compression of the electrical pulse may result as discussed previously.

As previously discussed with respet to FIG. 27, mechanical distribution of the pulses may be achieved by connecting an electrical conductor 194 between the output of the pulse generator 44 and the input terminal of the distributor 182. The distributor 182 functions as a mechanical switch for transferring the incoming pulse to a mechanical rotor 196. The rotor 196 is caused to rotate by the engine at a speed commensurate with the engine and includes a conductor which rotates past connector terminals 198 to which each of the cables 188 is connected. A rapidly rising voltage pulse appears on the input cable 194 which ionizes a small gap between the rotor 196 conductor and the terminals 198, thus closing a circuit so that current from the pulse flows to the corresponding PFN 50 and ignitor unit 52.

Figure 37:
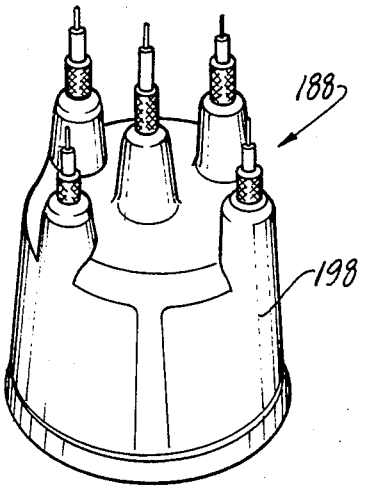
FIG. 37 is a perspective view of a distributor cap for use in the systems shown in FIGS. 27 and 28.

As shown in FIG. 37, a distributor cap 198 adapted to a conventional mechanical distributor to include an exterior ground bus which is connected in common with the ground of the distribution cables 188. The ground bus and coaxial nature of the cables 188 assure minimum inductance and losses.

Figure 38:
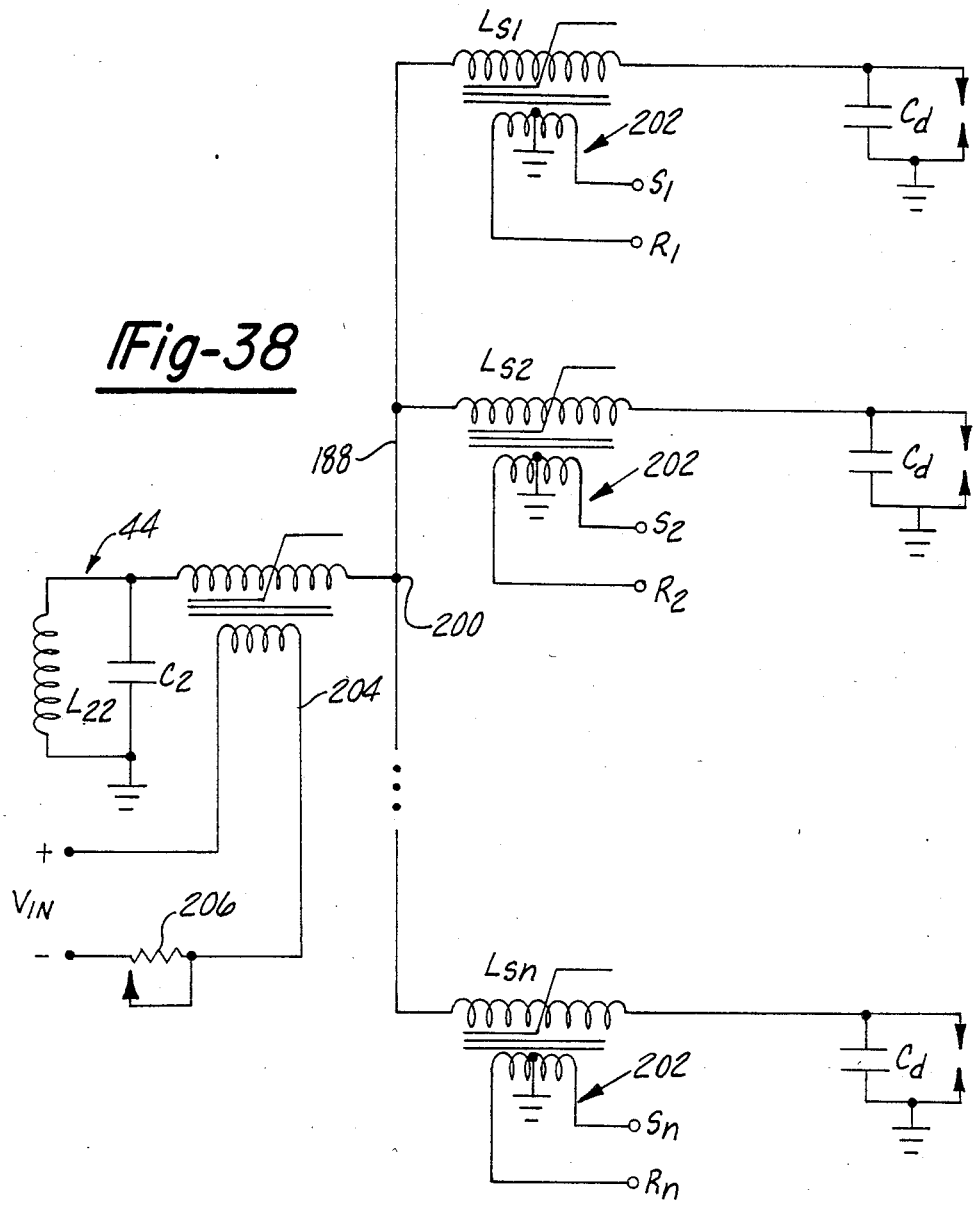
FIG. 38 is a detailed schematic diagram of a circuit for distributing high voltage pulses using saturable inductor switching.

Conventional mechanical distributors are limited to an operating voltage range between 15 and 35 kv. Internal arcing between the contacts of these distributors at high voltage sometimes occurs which may prevent proper switching and at reduced voltages, proper switching may not be achieved due to insufficient ionization contacts. Accordingly, the present invention contemplates an alternate form of switching and distribution which is depicted in FIG. 38. The alternate form of distribution and switching is accomplished using resettable saturable inductors and by creating a high impedance on all of the output lines 188 except that line to which a pulse is to be delivered.

The output of the pulse generator 44 is delivered to a bus point or common connection 200. The coaxial distribution cables 188 are each connected with the buspoint 200. Each of the distribution lines 188 includes a saturable inductor $L_s$ which is connected in series between the bus point 200 and the closely coupled PFN 50 and ignitor unit 52. Each of the saturable inductors $L_s$ includes a core bias winding 202 having a pair of leads S, R for respectively setting and resetting the core of the saturable inductor.

The saturable inductors $L_S$ possess hysteresis characteristics which are employed to achieve selective conductivity (switching) by driving the magnetic cores of the inductors $L_S$ forward or backward along the hysteresis curve. This creates a lesser or greater impedance to the flow through the inductor. This "biasing" of the inductors is achieved through the bias windings 202. The direction of current flow through the bias windings 202 determines the response of the inductor $L_S$ to either forward or reverse current flow therethrough. If the saturable inductor $L_S$ is reverse biased, i.e., the signal present on line R, current flow through the inductor is precluded. If the saturable inductor is forward biased by a signal on the set line S, current is allowed to flow through the saturable inductor.

A pulse output from the pulse generator 44, is delivered through the bus point 200 to each of the cables 188 and corresponding saturable inductors $L_{S1}$–$L_{SN}$. Simultaneously, relatively low voltage signals are delivered to the set and reset lines of the bias windings 202 of all of the saturable inductors. These control signals for the bias windings 202 may be derived from a conventional mechanical distributor or other suitable source of control signals such as the circuit shown in FIG. 40 which will be discussed later. The saturable inductor through which the high voltage pulse is to be delivered receives a signal on its S line, thereby forward biasing the corresponding bias winding 202 while the remaining bias windings 202 receive a reverse biasing signal on their reset lines R.

Figure 39:
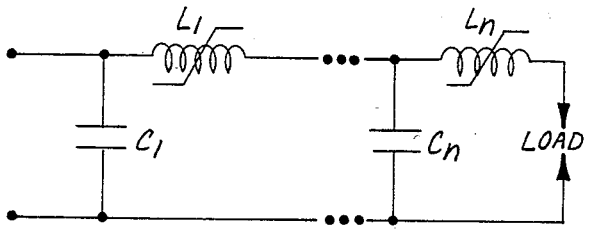
FIG. 39 is a schematic diagram of a multistage saturable inductor circuit for pulse compression.

In some applications, it may be necessary to "overvolt" the discharge gap of the ignitor unit 52 as previously discussed. Overvolting may result in a variation of energy partitioning in the discharge which can enhance the combustion process. Overvolting can be practically accomplished by generating a pulse which has a fast rise time. This pulse is delivered through one or more pulse compression stages which are depicted in FIG. 39. Each pulse compression stage consists of a capacitor $C_1$ and a saturable inductor $L_1$. In lieu of the saturable inductors, a self-breakdown spark-gap switch may be employed. Each of these stages, which were previously depicted as pulse compression units P in FIG. 27 can be connected between the common bus point 200 and the pulse generator 44, as shown in FIG. 38, or may be connected in each distribution line 188. Each of the pulse compression units shown in FIG. 39 preferably exhibits smaller inductance than the previous stage. The "voltage hold-off" and impedance characteristics described above effectively shorten the rise time of the voltage pulse, thereby compressing the pulse. This is advantageous in that the energy level within the pulse may be reduced while producing similar combustion effects.

In some cases, it may be desirable because of varying environmental conditions to maintain the core characteristics of the saturable inductor of the pulse compression stages. As shown in FIG. 38, this may be accomplished by the use of a stabilization winding 204 on which a voltage is impressed through a variable bias adjustment 206.

Figure 40:
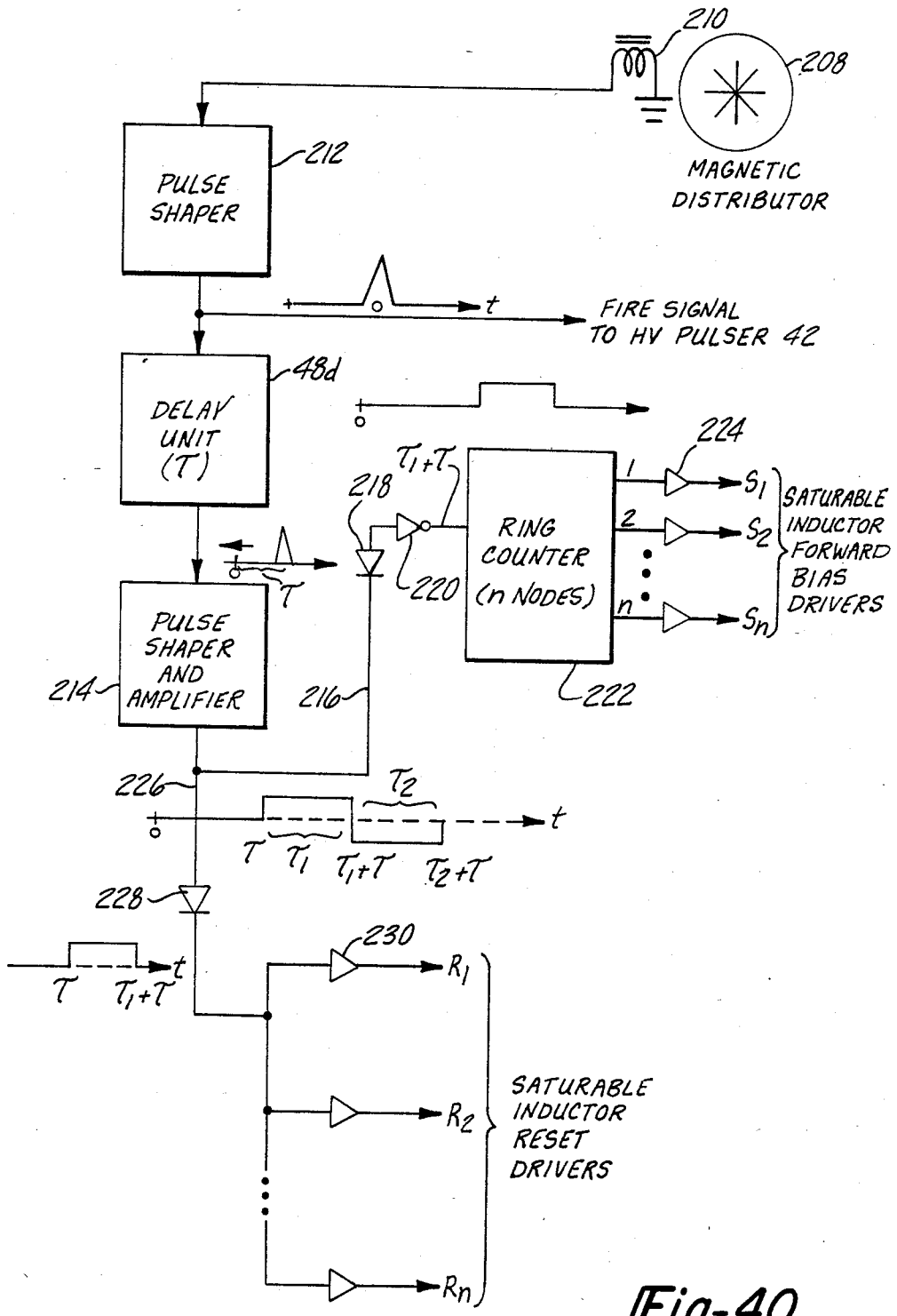
FIG. 40 is a combined block and schematic diagram of a control system for supplying control signals to the distribution system depicted in FIG. 38.

The control signals for controlling the bias windings 202 may be supplied by a distribution system depicted in FIG. 40. Timing pulses corresponding to engine firing are derived from a magnetic distributor 208. A magnetic pickup coil 210 senses the timing pulses and delivers them to a pulse shaper 212 which sharpens the pulse and delivers it both to the charging network 42 and time delay unit 48*d*. The delayed pulse output from delay unit 48*d* is delivered to a pulse shaper and amplifier 214, on line 216 through a blocking diode 218 and inverter 220 to a ring counter 222. Ring counter 222 includes a plurality of output lines $S_1$–$S_n$, each having an amplifier 224 delivering an amplified signal to the corresponding set or forward bias winding line of the bias windings 202 shown in FIG. 38. The pulses output from the shaper and amplifier 214 are also delivered on line 226 through a diode 228 to a plurality of reset driving lines $R_1$–$R_n$. Each of the driving lines $R_1$–$R_n$ includes an amplifier 230 for delivering an amplified control signal to the corresponding core reset or reverse bias lines of the bias windings 202 mentioned above.

The pulse output from the shaper and amplifier 214 is a bipolar square wave, the first half of which triggers the reset lines $R_1$–$R_n$ associated with the saturable inductor $L_S$–$L_N$ while the second half of the square wave triggers the associated forward bias of the selected winding $S_1$–$S_N$. As previously mentioned, the time delay unit **48*d* delays the pulse to allow the pulse generator 44** to fully charge the capacitor $C_1$ and complete firing of the preceeding pulse.

From the foregoing, it is apparent that the combustion initiation employing hard discharge described above not only provides the reliable accomplishment of the objects of the invention but does so in a particularly effective and efficient manner. It is recognized, of course, that those skilled in the art may make various modifications and additions to the preferred embodiment choosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

We claim:

1. A method of initiating combustion of a fuel-air mixture using a discharge device having a pair of spaced apart electrodes between which an electrical discharge channel may be formed, comprising the steps of:

(A) storing a quantity of electrical energy in a low inductance energy storage device;

(B) producing an electrical discharge channel between said electrodes using energy stored in said device, said discharge channel being defined by a damped oscillatory current flow; and (C) transferring at least approximately 80 percent of the energy stored in said storage device to said discharge channel within the first half period of said current flow.

2. The method of claim 1, wherein step (A) is performed by storing said quantity of electrical energy substantially at said discharge device.

3. The method of claim 1, wherein step (B) is performed by switching said discharge device into a circuit containing said storage device.

4. A method of initiating combustion of fuel-air mixtures in an internal combustion engine using a capacitive discharge ignition system, comprising the steps of:

(A) producing a supply of electrical power;

(B) charging a capacitor with a quantity of electrical energy which is sufficient in magnitude to initiate combustion of said fuel-air mixture, using said electrical power produced in step (A);

(C) forming an electrical discharge channel of alternating electrical current between the electrodes of an electrical discharge device having a pair of said electrodes; and (D) transferring at least approximately 80 percent of said stored quantity of electrical energy to said discharge channel within the first one-half cycle of said current.

5. The method of claim 4, wherein said capacitor is charged to a voltage of between approximately 20,000 and 40,000 volts.

6. A method of initiating combustion of a quantity of gaseous fuel, comprising the steps of:

(A) storing a quantity of electrical energy at a storage location;

(B) producing an electrical discharge channel between a pair of spaced apart electrodes using electrical energy stored in step (A);

(C) transferring at least approximately 80 percent of the quantity of energy stored in step (A) to said discharge channel in less than approximately 30 nanoseconds.

7. A method of initiating combustion of fuel-air mixture in an internal combustion engine using a capacitive discharge system, comprising:

subjecting each fuel-air mixture to a hard discharge electrical breakdown having a hardness factor $\phi$ equal to or less than approximately 0.5, where $\phi$ is defined by the equation $$\phi \simeq \frac{L/lg}{\frac{tm^2}{4Clg} + \frac{2Rmtm}{3lg} + \frac{L}{lg} - 1},$$

where $t_m$ is the time (in nanoseconds) at which the rate of rise of current flow in the system is substantially maximum, $R_m$ is the resistance in ohms of the electrical arc channel at $t_m$, C is the capacitance in nanohenries of the system, and lg is the length in centimeters of the gap between which the arc occurs.

8. The method of claim 7, wherein $$t_m \simeq (236/E_o)(P/P_o)^{\frac{1}{2}},$$

where, $E_o$ is the breakdown electrical field of a gap in which the breakdown occurs, in kilovolts/centimeter, and $P/P_o$ is the ratio of ambient gap pressure to atmospheric pressure.

9. The method of claim 7, wherein said hardness factor $\phi$ is less than 0.3.

10. The method of claim 1, including the step of maintaining the ratio of the inductance of said energy storage device and said discharge device to the length of said discharge channel to a value of less than approximately 100 nanohenries per centimeter.

11. The method of claim 4, including the step of maintaining the ratio of the inductance of the electrical discharge circuit including said capacitor, a connection between said capacitor and said electrodes and said channel, to the length of said channel to a value less than approximately 80 nanohenries per centimeter.

12. The method of claim 7, including the step of limiting L/lg to a value of less than 100 nanohenries per centimeter.

13. The method of claim 7, wherein lg is between 0.01 and 1.0 centimeters.

14. The method of claim 7, wherein C is between 100 and 5000 picofarads.

* * * * *